US006517309B1

(12) United States Patent
Zaher

(10) Patent No.: US 6,517,309 B1
(45) Date of Patent: Feb. 11, 2003

(54) PUMPING APPARATUS AND METHODS

(75) Inventor: Mouafak Arif Zaher, Auckland (NZ)

(73) Assignees: Unitec Institute of Technology, Auckland (NZ); Mouafak Arif Zahler, Auckland (NZ)

( * ) Notice: Subject to any disclaimer, the term of this patent is extended or adjusted under 35 U.S.C. 154(b) by 0 days.

(21) Appl. No.: 09/623,476

(22) PCT Filed: Mar. 12, 1999

(86) PCT No.: PCT/NZ99/00029

§ 371 (c)(1),
(2), (4) Date: Nov. 20, 2000

(87) PCT Pub. No.: WO99/46513

PCT Pub. Date: Sep. 16, 1999

(30) Foreign Application Priority Data

Mar. 13, 1998 (NZ) ..... 329969
Feb. 26, 1999 (NZ) ..... 334408

(51) Int. Cl.[7] ..... F04D 29/42

(52) U.S. Cl. ..... 415/1; 415/58.4; 415/116; 415/151

(58) Field of Search ..... 415/52.1, 58.4, 415/116, 118, 151, 11, 1

(56) References Cited

U.S. PATENT DOCUMENTS 3,588,266 A * 6/1971 Scott-Scott ..... 415/11
3,976,390 A * 8/1976 Silvern et al. ..... 415/53 R
4,964,783 A * 10/1990 Haverkamp ..... 415/52.1
5,333,638 A 8/1994 Maxwell ..... 137/116

FOREIGN PATENT DOCUMENTS

| | | |
|---|---|---|
| DE | 3308914 A1 | 9/1984 |
| GB | 1006365 | 9/1965 |
| GB | 2058218 A | 4/1981 |

OTHER PUBLICATIONS

Abstract and Figures for European Patent 0702156A1, Mar. 20, 1996, (Institute Francais Du Petrole).
Derwent Abstact and Figure for French Patent 2484025A, Dec. 11, 1981, (NEYRPIC).
Derwent Abstract Accession No. 94–165245/20, SU 1800137A1, Mar. 7, 1993, Ivano–Frank Oil Gas Inst.)

* cited by examiner

*Primary Examiner*—Edward K. Look
*Assistant Examiner*—Ninh Nguyen
(74) *Attorney, Agent, or Firm*—Jacobson Holman PLLC

(57) ABSTRACT

A pumping system including a pump having an inlet and an outlet, an inlet conduit connected to the inlet of the pump for the inlet flow of fluid to the pump. A delivery conduit connected to the outlet of the pump for the outlet flow of fluid from the pump. A point of bleeding at least part of the outlet flow. A mechanism of increasing the velocity head of bleed fluid flow, and a mechanism to inject a flow responsive to the condition of bleed fluid flow into the inlet conduit whereby in operation the injected flow increases at least the velocity head of inlet flow of fluid to the pump.

50 Claims, 17 Drawing Sheets

| | Pump A | Pump B |
|---|---|---|
| F ov | | |
| H(m) | 1.2 | 0.68 |
| Q(l/s) | 0.9 | 2.00 |
| 1/2ov | | |
| H(m) | 1.2 | 0.89 |
| Q(l/s) | 0.82 | 1.68 |
| 1/4ov | | |
| H(m) | 1.26 | 1.25 |
| Q(l/s) | 0.55 | 0.8 |
| Shut | | |
| H(m) | 1.3 | 1.18 |
| Q(l/s) | 0 | 0 |

PUMPING APPARATUS AND METHODS

TECHNICAL FIELD

The present invention relates to improved pumping apparatus and methods, and, in particular although not solely, to pumps (centrifugal) to operate in low suction head conditions.

BACKGROUND ART

Pumps such as centrifugal pumps have been manufactured for many years. They have been used in boiler feed, mine drainage and petroleum/chemical industry for the pumping of different fluids.

There are many places in process industries where low NPSH (Net Positive Suction Heads) are required for pumping liquids which are at or near their boiling points. In conventional pumps as the NPSH is reduced, cavitation sets in and it eventually becomes extensive enough to cause blockage of the blade passages, efficiency breakdown, and possibly also a gradual destruction of the components of the pump. As is well know, cavitation may be expected in a flowing liquid when the local pressure falls to the vapour pressure of the liquid. Local vaporisation of the liquid will then result, causing development of a vapour filled bubble or cavity in the flow. The low pressure cavity is swept down stream into a region of higher pressure where it collapses suddenly, the surrounding liquid rushing in to fill the void. At the point of disappearance of the cavity the in rushing liquids come together momentarily raising the local pressure within the liquid to a very high value. If such cavity collapse is near the boundary wall, such high local pressure can cause erosion of the wall material. An advantage of pumps having a low NPSH is the ability to reduce holding tank heights (and save construction cost), or to pump fluids which are near their boiling point, or by running the pump faster and replacing multi-stage (booster) pumps.

Development on pumps to reduce or eliminate cavitation at inlet include work on what is known as the super cavitating type of pumps which use an inducer upstream from the pumps impeller. Such an inducer is normally driven by the axle of the impeller and hence increase the demand for power from the motor driving the pump. In general, anti-cavitation pumps can increase the inlet type number (specific speed) of a high speed pump by two to three times, thus giving a generous margin of safety in respect of permissible NPSH.

The provision of a booster pump upstream from the centrifugal pump where cavitation may result is also a common way of overcoming cavitation. The boost pump increases the head of fluid at the centrifugal pump to there by reduce the occurrence of cavitation.

Yet an alternative development to conventional pumps includes the provision of guide vanes upstream of the impeller of the pump wherein the guide vanes provide a swirling motion to the intake fluid to improve the angle of incidence of the fluid flow with the leading edge of the impeller. The problem with both super cavitating pump and pumps having up stream guide vanes is related to the increase in surface area over which the intake fluid is required to flow hence creating a head loss as a result of friction. The booster pump or super-cavitating pump also require a further power input.

A further alternative way in which the performance of a pump may be improved by avoiding cavitation inside of the pump itself. Such cavitation may occur under partial load conditions. In UK Patent Application GB2058218 there is described a means of drawing fluid form the volute casing of a pump, collecting it in a cylindrical reservoir and directing the fluid via openings to the impeller blades at inlet. The configuration of this method is such to induce a backflow within impeller blades which counteracts the occurrence and development of the secondary flows in such a way that cavitation loading of the impeller for part-load conditions is eliminated or reduced. This specification however deals with minimisation of the energy loss as a result of secondary flows, sometimes called re-circulating flows. These are usually in the form of vortices with a direction of rotation opposite to that of the main stream. These are usually found at the tips of the impeller vanes on the exit and inlet sides. The losses are normally accounted for as part of the total loss assumed within the major elements of the pump, which also include frictional losses.

The function of the injection of fluid of the invention of GB2058218 is analogous to providing a series of fixed guide vanes before the impeller in order to guide the fluid in a certain direction in respect of partial load vortices.

U.S. Pat. No. 4,492,516 deals with the losses as a result of impeller re-circulation by the provision of passage ways shaped to direct the flow of fluid to be reinjected at the inlet of the impeller. As such head losses as a result of secondary flows or friction are small compared to the total headloss of the energy equation of fluid flow its reduction or elimination, although having some effect, proportionally it has very little effect on such energy.

It is therefore an object of the present invention to provide improved pumping apparatus and methods, and in particular although not solely to centrifugal pumps to operate in low suction head conditions, or which will at least provide the public with a useful choice.

DISCLOSURE OF THE INVENTION

Accordingly in a first aspect the present invention consists in a pumping system comprising means defining a pump having an inlet and an outlet, an inlet conduit connected to said inlet of said pump for the inlet flow of fluid to said pump a delivery conduit connected to said outlet of said pump for the outlet flow of fluid from said pump means adapted to bleed at least part of the outlet flow, means capable of increasing the velocity head of bleed fluid flow, and means to inject a flow responsive to the condition of bleed fluid flow into the inlet conduit whereby in operation the injected flow increases at least the velocity head of inlet flow of fluid to said pump.

Preferably said means adapted to bleed is connected for fluid communication by at least one conduit to said means to inject.

Preferably said means to inject is at least one nozzle in fluid connection via said at least one conduit with said means adapted to bleed.

Preferably said fluid connection with said means adapted to bleed and means to inject is controlled by at least one valve.

Preferably one control-valved conduit for fluid communication to each of said at least one nozzle, provides said fluid connection with said means to bleed.

Preferably said means capable of increasing velocity head is in the bleed fluid flow path between said delivery conduit and the said inlet conduit, and is adapted for the flow path for bleed fluid to be reduced in cross-sectional flow area to thereby increase the velocity pressure head of said bleed fluid flow prior to being injected into said inlet conduit.

Preferably said means capable of increasing velocity head is provided at said at least one nozzle in the form of a reduced cross-sectional flow area for bleed fluid flow.

Preferably said at least one nozzle comprises a passage for fluid with and inlet for bleed fluid to be received from said means adapted to bleed (via said conduit) and an outlet connected for fluid delivery to said inlet conduit, wherein said inlet of said nozzle is of greater cross sectional area that said outlet of said nozzle.

Preferably said passage of said nozzle is gradually tapered over the length of said passage between said nozzle inlet and said nozzle outlet such that the cross sectional flow area of said outlet is smaller that the cross sectional flow area of said inlet of said nozzle.

Preferably the ratio of said cross sectional flow area of said nozzle inlet to the cross sectional area of said to said nozzle outlet is substantially four.

Preferably said passage of said at least one nozzle is substantially circular in cross sectional area and the ratio of inlet diameter to outlet diameter is substantially two.

Preferably the ratio of the length of said passage to the diameter of said nozzle inlet is substantially two.

Preferably said at least one nozzle is engaged with said inlet conduit to, in use inject bleed fluid into the inlet conduit through said nozzle outlet at substantially right angles to the main flow direction of fluid in said inlet conduit.

Preferably said at least one nozzle is engaged with said inlet conduit to, in use inject bleed fluid into the inlet conduit through said nozzle outlet to induce a rotational flow to inlet flow of fluid approaching said pump.

Preferably there are at least two nozzles for injecting fluid into said inlet conduit.

Preferably there are four nozzles for injecting fluid into said inlet conduit.

Preferably said at least two nozzles are each positioned the same distance upstream of said pump.

Preferably said at least two nozzles are equi-spaced about the perimeter of said inlet conduit.

Preferably said pump is a centrifugal pump.

Preferably said at least one nozzle is engaged with said inlet conduit to in use inject bleed fluid into the inlet conduit through said nozzle outlet to induce a rotational flow to inlet flow of fluid approaching said pump co-rotatory with the rotational direction of the pump impeller.

In a further aspect the present invention consists in a method of pumping a liquid using a pump of a kind having an inlet conduit for input flow of fluid to the in flow chamber of said pump and an outlet conduit for output flow of fluid from the volute chamber of said pump, said method comprising;

bleeding of fluid from the outlet conduit, of a higher total pressure compared to the input flow total pressure increasing the velocity energy of the bled fluid and injecting of the bled fluid into the inlet conduit to increase the velocity energy of said input flow.

Preferably said velocity energy of said bled fluid from said outlet conduit is increased as a result of restricting the bleed flow path area of said bled fluid prior to injecting.

Preferably said bleeding of fluid is a controlled portion of the total output flow.

Preferably said bleeding of fluid is controlled by a control valve in a bleed flow Preferably said bleed flow path is restricted as a result of tapering in the bleed flow conduit between said bleeding and said injecting.

Preferably said control valve is responsive to cavitation and/or performance conditions of the pump whether by means of micro processor, computer or other logic control means responsive to sensors.

Preferably flow or pressure or flow difference or pressure difference activated valving systems without logic control can be used.

Preferably the pump is a centrifugal pump.

Alternatively the pump is an axial flow pump.

Yet alternatively the pump is a mixed flow/diagonal type pump.

Preferably said injecting of bled fluid into said inlet conduit imparts a rotatory flow in the input flow to the pump which is co- rotatory to the rotation of the pump impeller.

Alternatively said injecting of bled fluid into said inlet conduit imparts a rotatory flow in the input flow to the pump which is counter- rotatory to the rotation of the pump impeller.

In still a further aspect the present invention consists in a nozzle unit for injecting fluid into the main inlet flow stream of a pump comprising;

a conduit section capable of insertion into the main inlet conduit defining the flow boundary to said inlet flow stream of said pump said conduit section comprising an inlet outlet a wall defining region there between to provide a substantial continuation of the boundary to the main inlet flow stream of fluid, and at least one aperture through said wall defining region an injection nozzle for said at least one aperture to in use deliver through said aperture a fluid, said injection nozzle comprising;

a conduit having an inlet and an outlet said outlet being at said at least one aperture through said wall defining region such that a fluid communication can be established between the inlet to said conduit of said nozzle and said main inlet flow stream wherein the flow area of said inlet to said conduit is larger than said outlet to said conduit.

Preferably said conduit of said nozzle is secured to said conduit section such that in use the flow path of injected fluid at said outlet to said conduit is at substantially right angles to the main inlet flow stream of a said pump.

Preferably at least said inlet an outlet of said conduit section are of complementary shape to the boundary defining region of said main inlet conduit Preferably said wall defining region of said conduit section is defined by a substantially constant diameter bore corresponding to the diameter of said main inlet conduit.

Preferably said conduit of said nozzle is secured to said conduit section such that in use the flow path of injected fluid at said outlet to said conduit is at substantially right angles to the main inlet flow stream of a said pump and at a tangent to said boundary of said main inlet conduit.

Preferably said inlet of the conduit of said nozzle is of a flow area substantially four times that of the flow area of the outlet to said conduit.

Preferably said conduit of said nozzle is in cross section substantially circular.

Preferably said conduit is gradually tapered between said inlet and said outlet over a distance substantially twice that of the diameter of said inlet to said conduit.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

Preferred forms of the present invention will now be described with reference to the accompanying drawings in which;

BRIEF DESCRIPTION OF THE DRAWINGS

FIG. 26 is a perspective view of one preferred form of a nozzle unit.

DETAILED DESCRIPTION OF THE INVENTION

Figure 1:
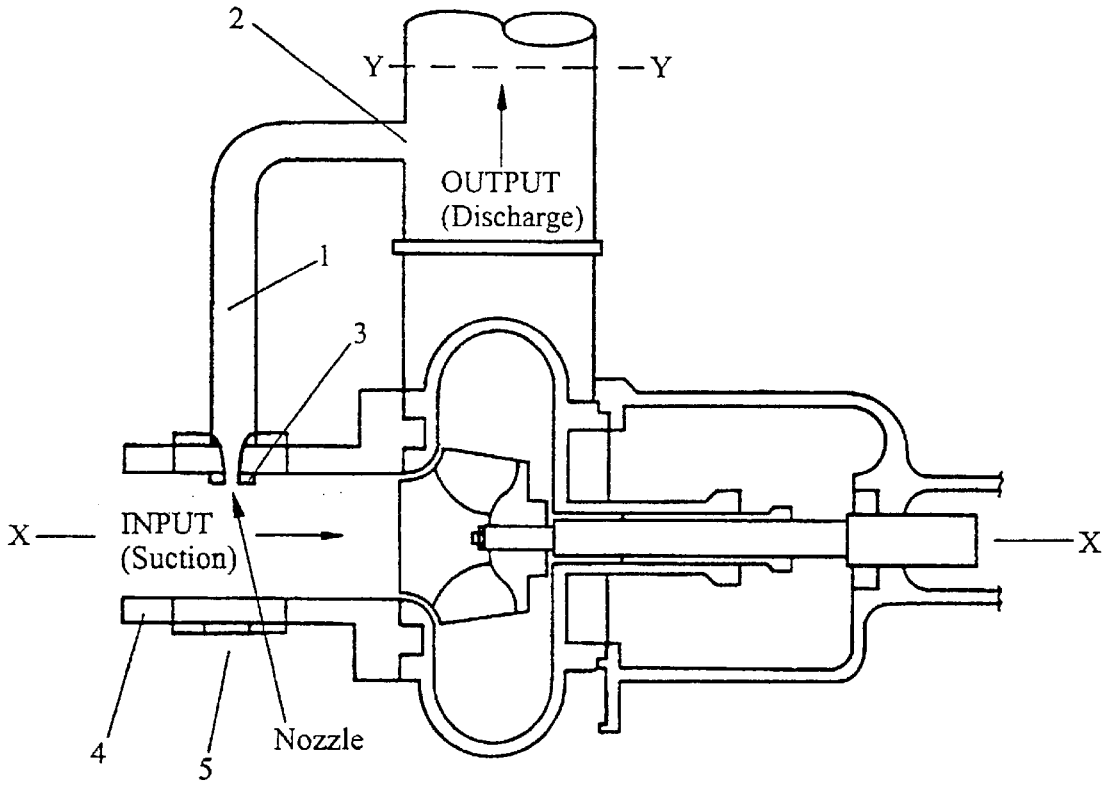
FIG. 1, by way of example, is a plan view diagrammatically showing a pump and a bleed control adapted to provide a drawing off of liquid from the output of the pump and the injection thereof into the input of the pump, the broken line "XX" showing an axis about which in one rotational direction the impeller of the pump rotates and the preferred co or counter rotatory motion on the input or suction side of the pump is preferably induced.
Figure 25:
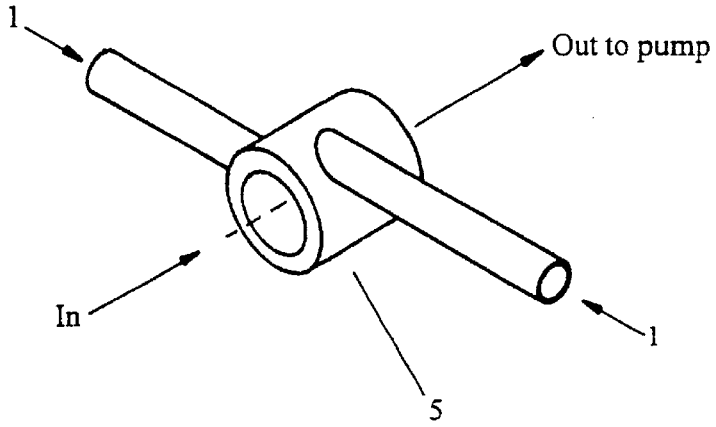
FIGS. 24–25 are as herein described with reference to the formulas.

As used herein "counter rotatory" or "co-rotatory" to the impeller motion does not imply any correspondence in rotational speed of (a) the rotary motion or the bleed stream or nozzle induced rotating liquid to that of (b) the rotating speed of the impeller or to the axial orientation of the impeller with respect to the flow rotation at injection.

Nomenclature

A cross sectional area of nozzle, $B_N$ bleeding number=$N \times A \times C_d/Q_w$, $b_1$ vane inlet breadth, $b_2$ vane exit breadth, C Absolute velocity, $C_{1u}$ circumferential velocity component on entrance of impeller, $C_{2u}$ circumferential velocity component on exit, $C_a$ axial velocity in entrance channel, $C_d$ fluid velocity at exit from nozzle, $d_n$ nozzle diameter, $D_d$ delivery pipe internal diameter, $D_s$ Suction pipe internal diameter, $d_B$ bleed pipe diameter to nozzle, $H_o$ head at operating point for conventional pump, $\Delta H$ total head difference between conventional and new pump arrangement, $L_n$ nozzle tapered length, N number of nozzles, n speed, $P_1$ static pressure at entrance of impeller, $P_a$ ambient pressure, $\Delta p$ swelling, $\Delta P_c$ total swelling, $\Delta P_t$ theoretical swelling, $\Delta P_z$ pressure fall in valve, $P_c$ total power, $P_b$ power due to secondary losses, $P_m$ power loss due to friction in bearings (mechanical), Q volume of a stream of fluid, $Q_d$ volume of stream of fluid through nozzle, $Q_0$ volume of stream of fluid at operating point, $Q_w$ volume of a stream of fluid through the impeller, $r_1$ inlet radius to the pump, $r_2$ exit radius to the pump, R,r radius, $R_d$ distance from nozzle exit to axis of impeller, Re Reynolds number, $R_{in}$ radius at entrance, Ro Rossby number (Vr/(Rn)-dimensionless group, $R_{ex}$ radius at exit, $U_1$ rotational velocity at entrance to impeller, $U_2$ rotational velocity at exit from impeller, V velocity of fluid at radius r, w relative velocity, β entrance angle, ρ density of fluid, ω angular velocity, λ hub/tip ratio, ϕ coefficient of flow Where herein mentioned with reference to the nozzles and by example 2N×4 mm $d_B$ means two nozzles each with a nozzle diameter ($d_B$) of 40 mm, 2×2 N refers to two nozzle units in series each of two nozzles.

| | |
|---|---|
| FOV | fully opened valve |
| ½ OV | ½ open valve |
| ¼ OV | ¼ open valve |

The present invention will now be described to show how development and control of the suction or input side fluid injection has allowed the adoption of higher operating speeds without embarrassment of high NPSH requirements. It will also be shown that preferably such injection is provided with a rotary motion ahead of the impeller and by transferring part of the energy of fluid at the delivery side of the pump, back to the suction side using at least one nozzle(s) placed in the suction line, improves the overall efficiency of the pump arrangement. The control action preferably takes place through the aid of a valve system, which when it is closed position would allow a 100% delivery side discharge. Changes in discharge, pressure and power will occur during the action of opening the control valve system, however these are offset by improved intake flow at low NPSH.

As is well known for incompressible flow of uniform density fluid the static pressure head plus velocity pressure head plus any losses as a result of, for example friction, remains constant .i.e $$\frac{P}{\gamma} + \frac{v^2}{2g} + H_{Losses} = C$$

It is known that on a suction side of a pump as result of frictional losses from the walls of the conduit, the head loss can be a factor in contributing to reduce the total local pressure of the fluid where at some point in the pipe this pressure becomes, less than the vapour pressure of the fluid resulting in cavitation. Losses may also be incurred by secondary flows such as eddies which may form at the impeller entrance of a pump. These eddies can also reduce the total local pressure of the fluid and contribute with other factors to the formation cavitation. However the present invention does not in a primary aspect deal with the total local pressure drop as a result of these losses. It is only the secondary results of a preferred embodiment of the present invention which may also increase the total local pressure by reducing or eliminating these losses.

The prior art which deals with modifying the flow of intake fluid normally deals with reducing the head losses as such a result of such secondary flows. The known use of booster pumps positioned upstream from the main centrifugal pump increase the pressure head to ensure the total local pressure of fluid upstream from the impeller remain above the vapour pressure of the fluid. The current invention deals with increasing the velocity head:

$$\frac{v^2}{2g}$$

of the fluid at inlet, achieved by bleeding from the delivery side, fluid at an increased static pressure (as a result of the pump) to the suction side in such a way to increase its velocity head which is injected into the suction side and hence increases the acceleration of the fluid at suction and therefore increases its total local pressure.

With reference to FIG. 1 a conduit 1 is positioned between the discharge and inlet of the pump. The pump in this instance is a centrifugal pump wherein the axis of rotation of the impeller is substantially co-axial with the inlet pipe. The present invention does have applicability to other pumps including centrifugal pumps wherein the axis of rotation of the impeller is at right angles to the inlet pipe.

The conduit 1 provides a connection between the point of bleeding 2 and the at least one nozzle 3 of the arrangement. The conduit 1 is preferably a circular cross section and may be provided with a valve between points 2 and 3.

The nozzles are placed in the suction pipe or at a suitable point where the best results in ΔH are achieved for the particular pump being utilised. This position does vary from pump to pump and needs to be determined experimentally. The present invention is not necessarily limited to there being only one point of injection into the suction pipe. Indeed this is not preferred and it has been shown by experimentation that at least two and preferably four nozzles in a nozzle unit provide the best ΔH. Accordingly each nozzle of a nozzle unit has preferably a separate conduit 1 to provide the fluid connection between the bleeding means of the output and the input pipe. Hence preferably there are also corresponding numbers of points of bleeding on the upward pipe. These are preferably positioned about a pipe at approximately equal space there around. More than one nozzle unit, placed in series may also be appropriate.

The fluid of higher static pressure head on the delivery side (or out put side) of the pump is bled at a rate through conduit(s) 1 to at least one nozzle positioned upstream of the pump to bleed the fluid from the discharge line to the suction line. In the preferred form of the invention, prior to the point of injection of the bleed fluid the velocity head energy is increased. This is preferably achieved by a reduction in cross sectional area of the fluid passage. As opposed to increasing the energy of the suction line fluid by bleeding fluid into the suction line with a high static pressure head, the injection of fluid with a high velocity head has less demand on the delivery side total pressure head. As the principle of a centrifugal pump is to convert velocity head of the inlet fluid to static pressure head of the outlet fluid, bleeding fluid with a high static pressure head back into the delivery side would relatively reduce the output while achieving of higher total pressure head, higher overall efficiency and lower power input. These were proved experimentally.

As the kinetic energy of the fluid is dependent on the $V^2$ (the velocity of injected fluid) the addition of energy as a result of an increase in velocity from the delivery side to the suction side is a more effective way of increasing the energy of the flow entering the impeller. In this respect 2:1 ratios of flow path diameter have shown experimentally to provide the best ΔH.

Figure 5:
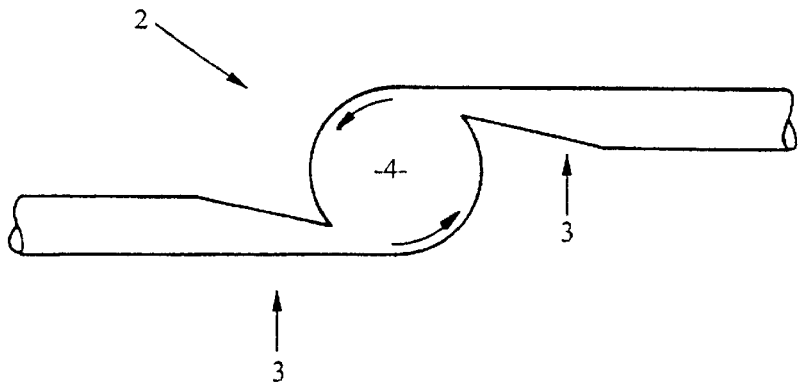
FIGS. 5 to 7 illustrate in section a preferred configuration of a nozzle unit and delivery conduit, wherein the nozzle unit has two or four nozzles for injecting the bleed flow from the output flow of the pump at points on the suction side.
Figure 6:
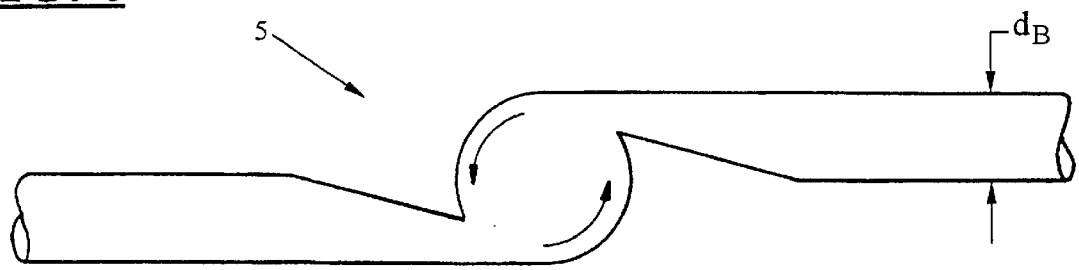
Figure 7:
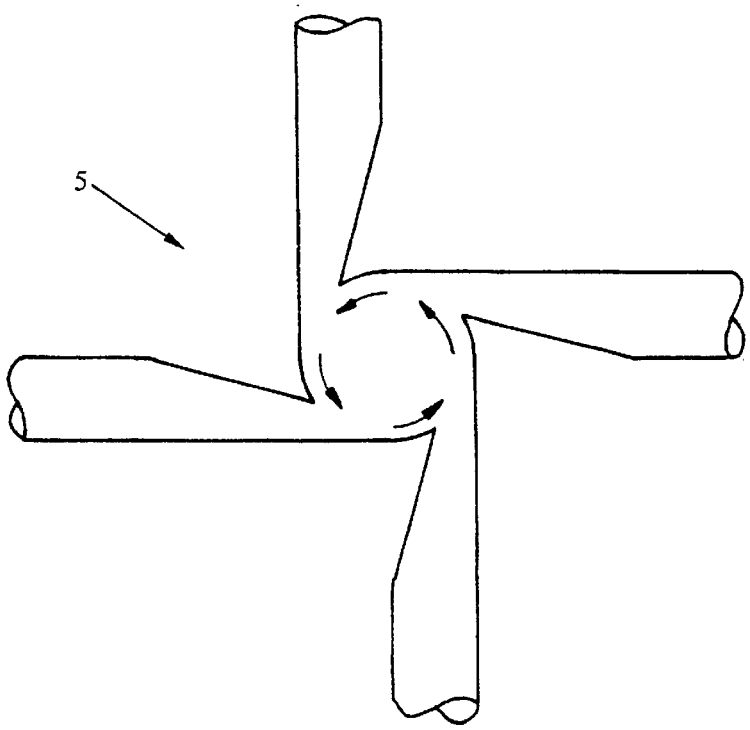
Figure 8:
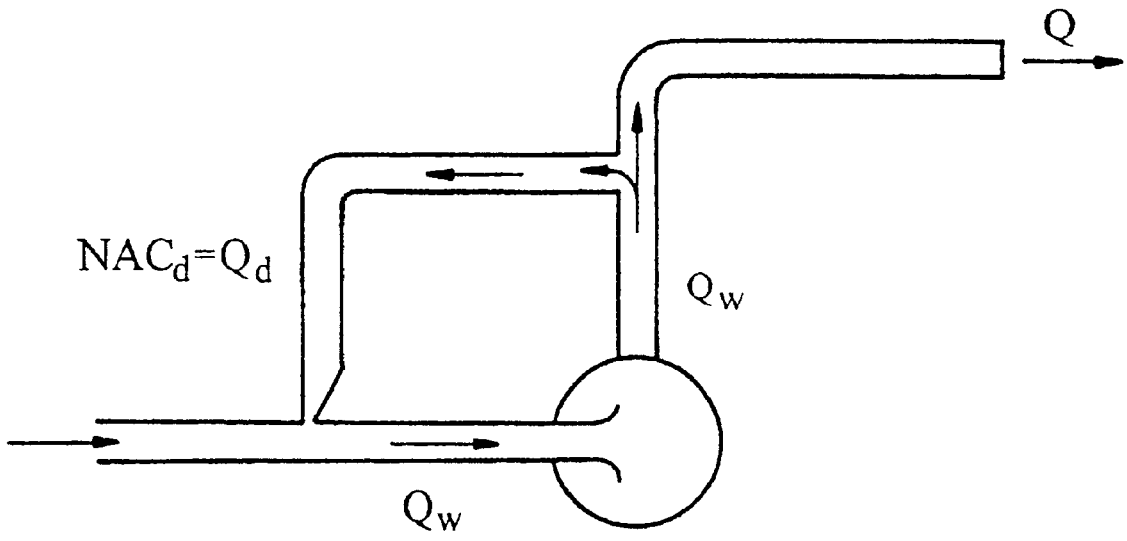
FIG. 8 is a schematic view of the flow of fluid from suction to the delivery side including the flow diversion from the point of bleeding to the point of injection.
Figure 9:
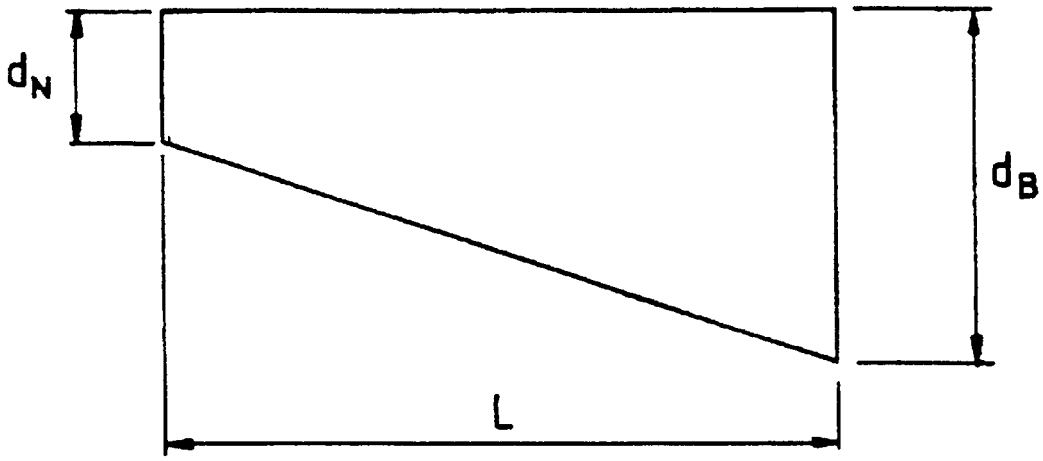
FIG. 9 illustrates the dimensions of a nozzle.
Figure 10:
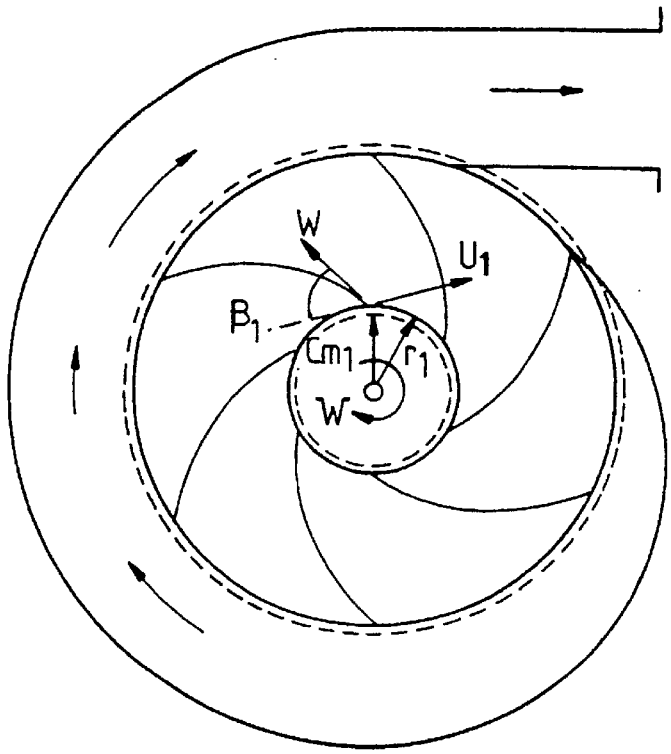
FIG. 10 illustrates a sectional view of an impeller wherein there has been illustrated the flow velocities of fluid in respect of the impeller entrance.
Figure 11:
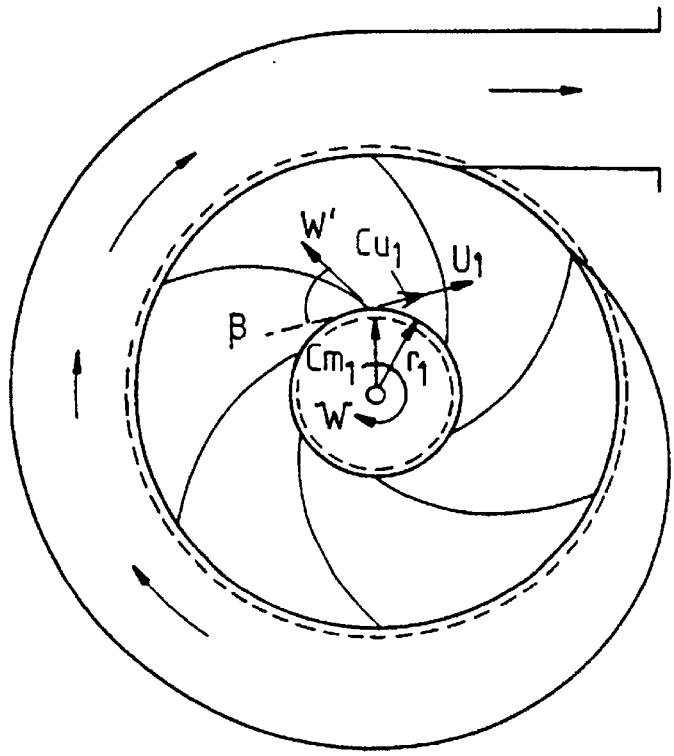
FIG. 11 illustrates a sectional view of an impeller wherein there has been illustrated the flow velocities of fluid in respect of the impeller entrance, wherein a pre-rotation adds to the velocity vector $C_{u1}$.
Figure 12:
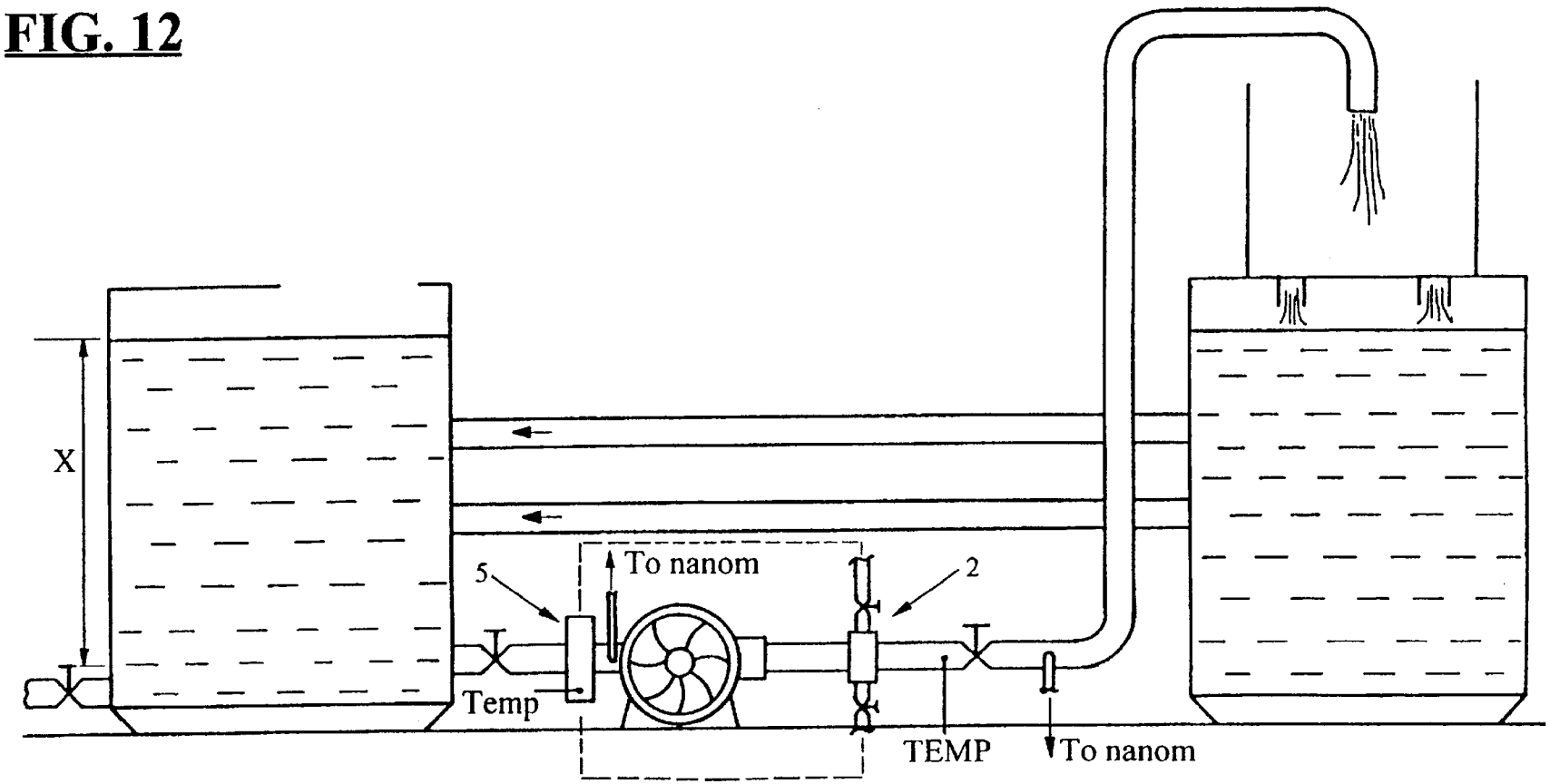
FIG. 12 is a schematic view of the testing facilities used wherein the fluid for delivery to the pump has a delivery head X.
Figure 13:
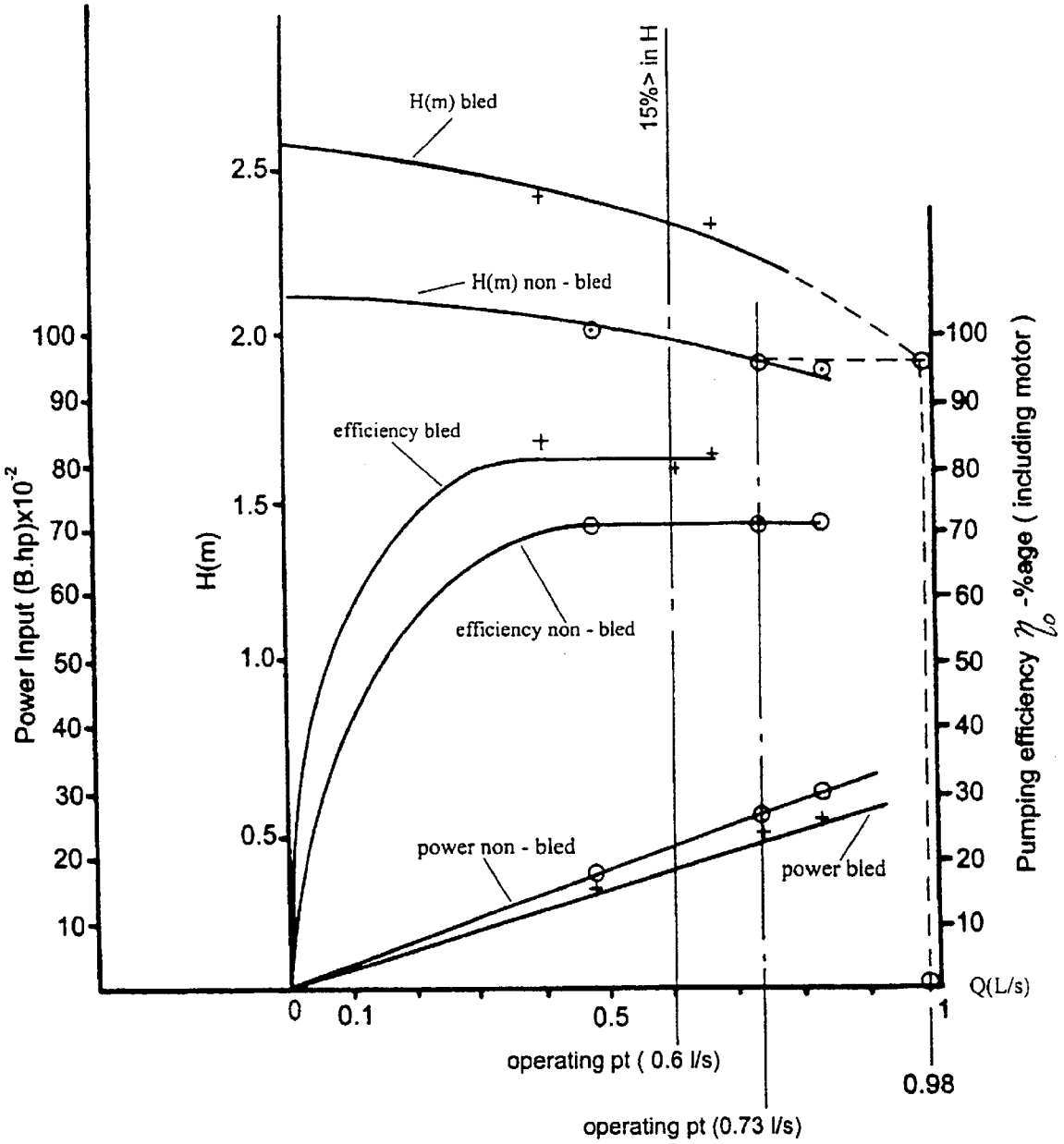
FIG. 13 is a plot of performance characteristics of test results conducted as herein after defined wherein a four nozzle unit with a nozzle diameter of 12 mm was used wherein the fluid prior to the pump had a suction lift of 875 mm, for test pump A.
Figure 14:
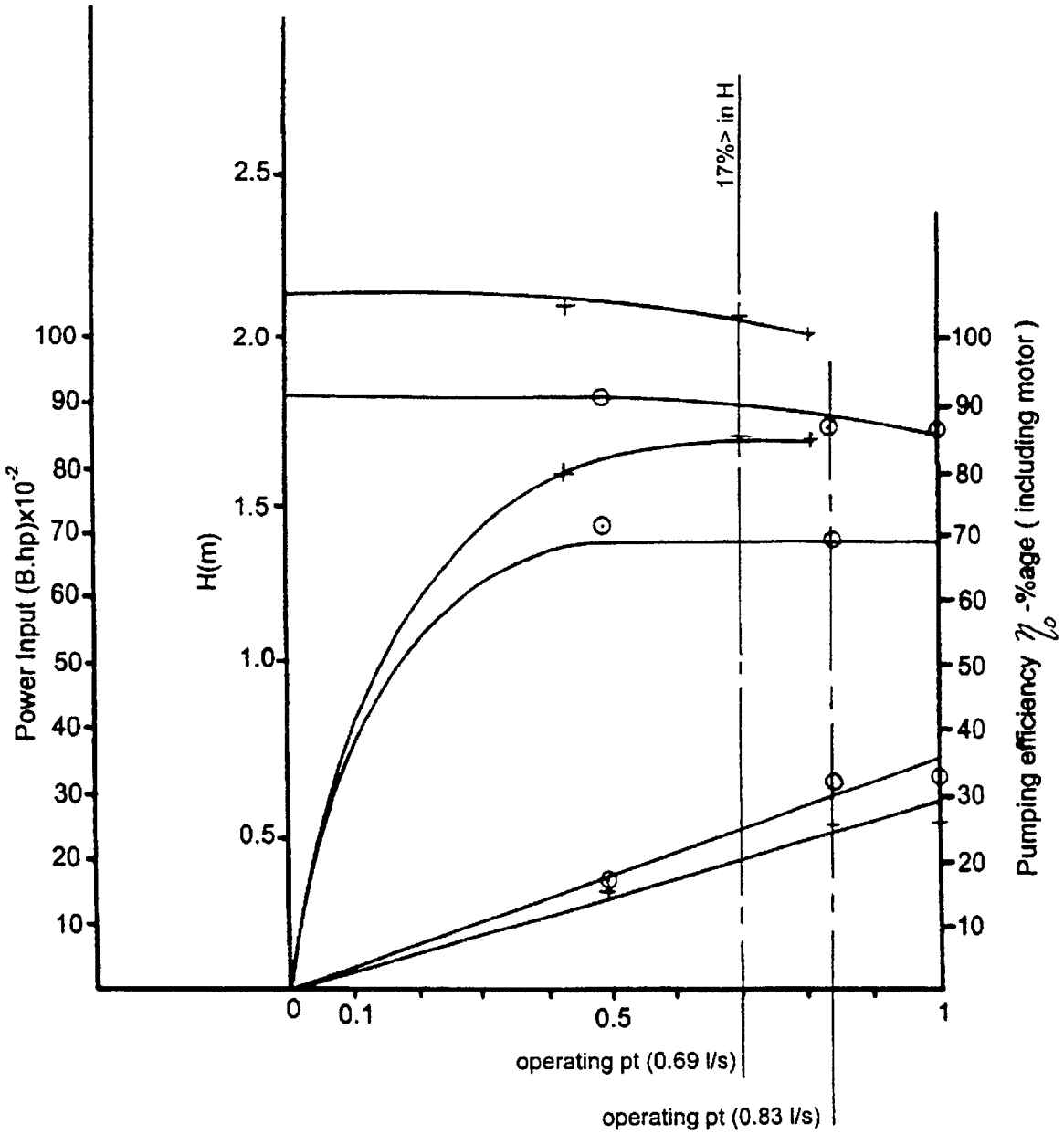
FIG. 14 is a plot of performance characteristics of test results conducted as herein after defined wherein a four nozzle unit with a nozzle diameter of 12 mm was used wherein the fluid prior to the pump had a suction head of 557 mm, for test pump A.
Figure 15:
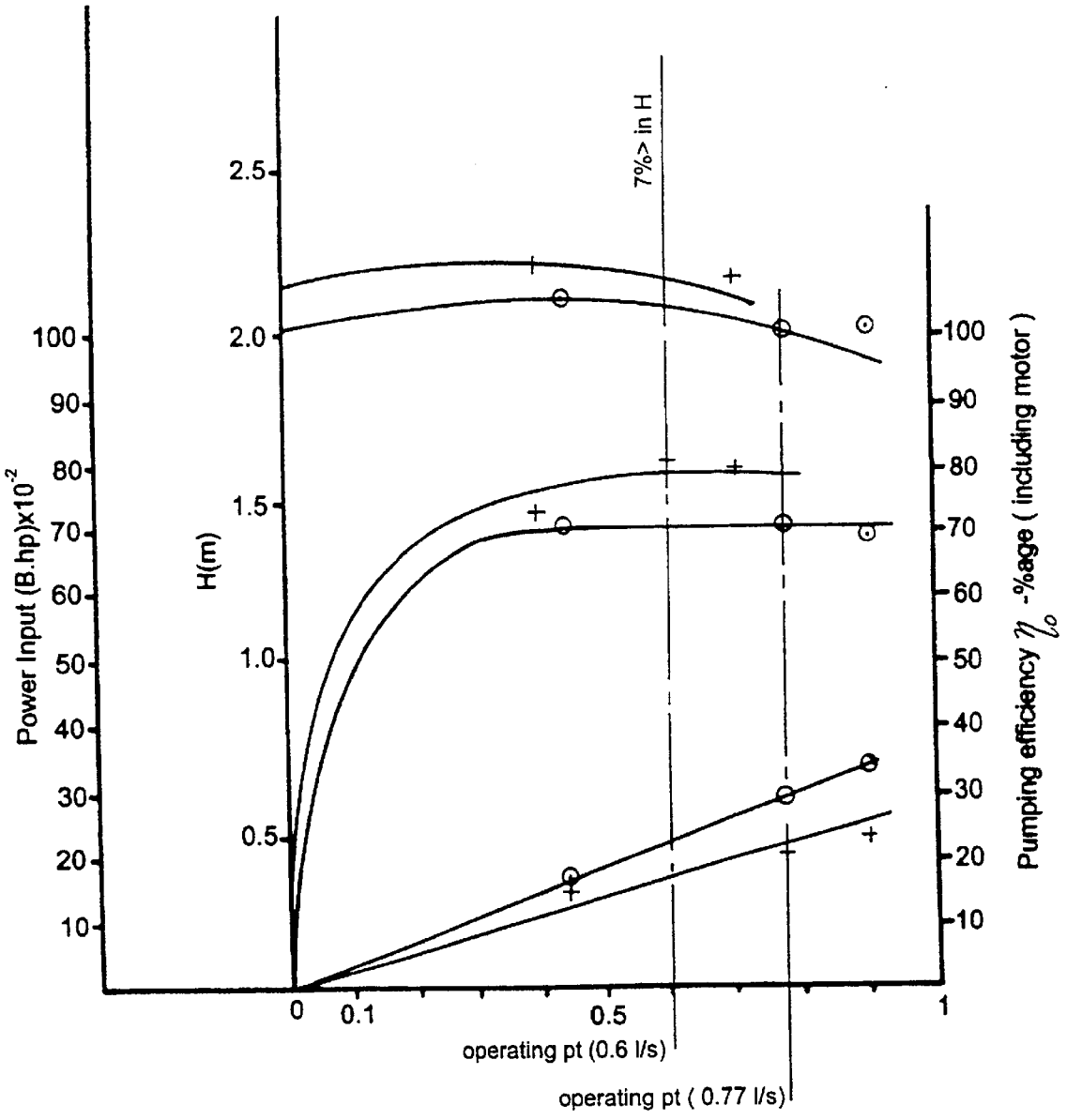
FIG. 15 is a plot of performance characteristics of test results conducted as herein after defined wherein a four nozzle unit with a nozzle diameter of 12 mm was used wherein the fluid prior to the pump had a suction head of 105 mm, for test pump A.
Figure 16:
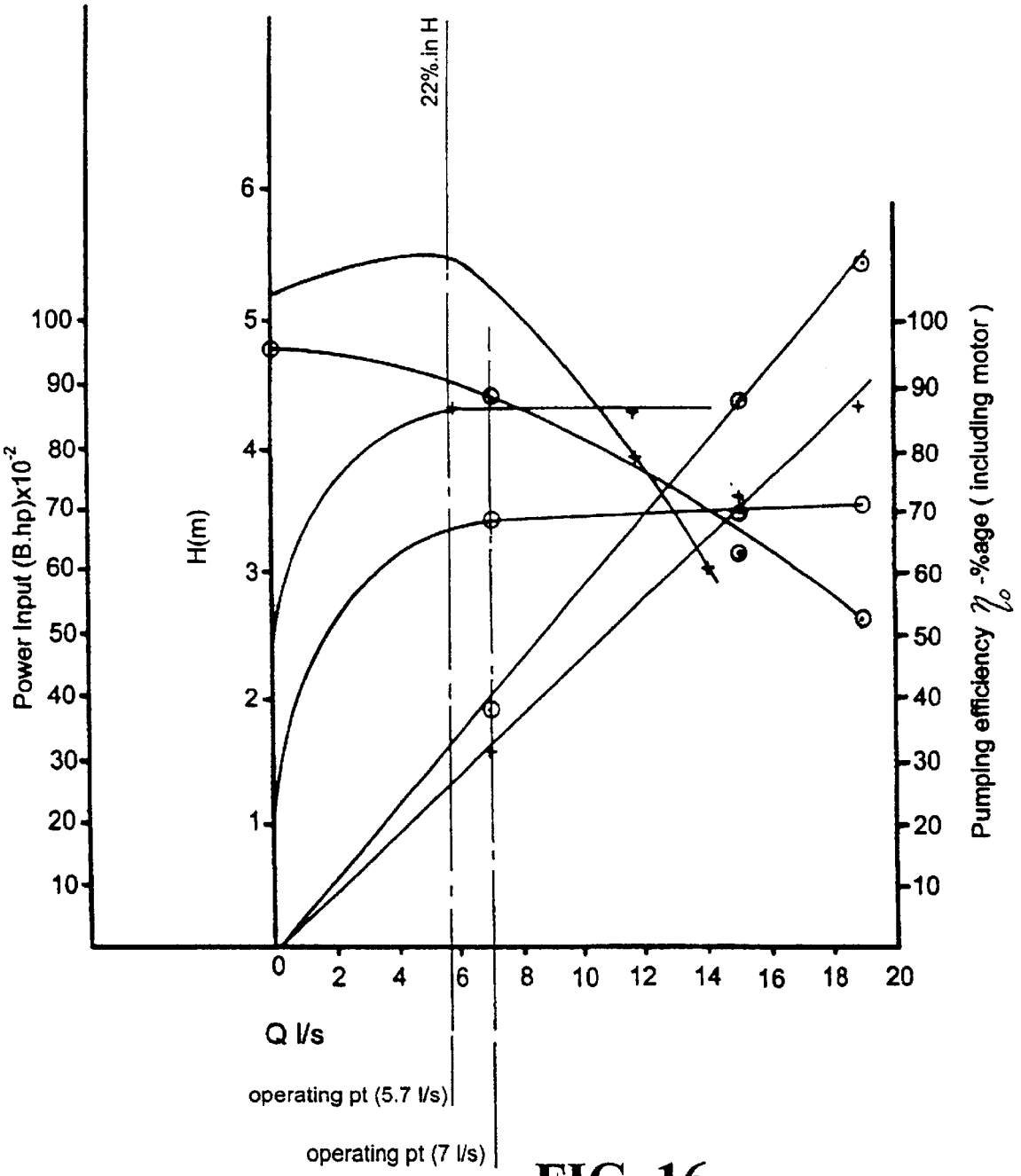
FIG. 16 is a plot of performance characteristics of test results conducted as herein after defined wherein a four nozzle unit with a nozzle diameter of 40 mm was used wherein the fluid prior to the pump had a suction lift of 1 500 mm, for test pump B.
Figure 17:
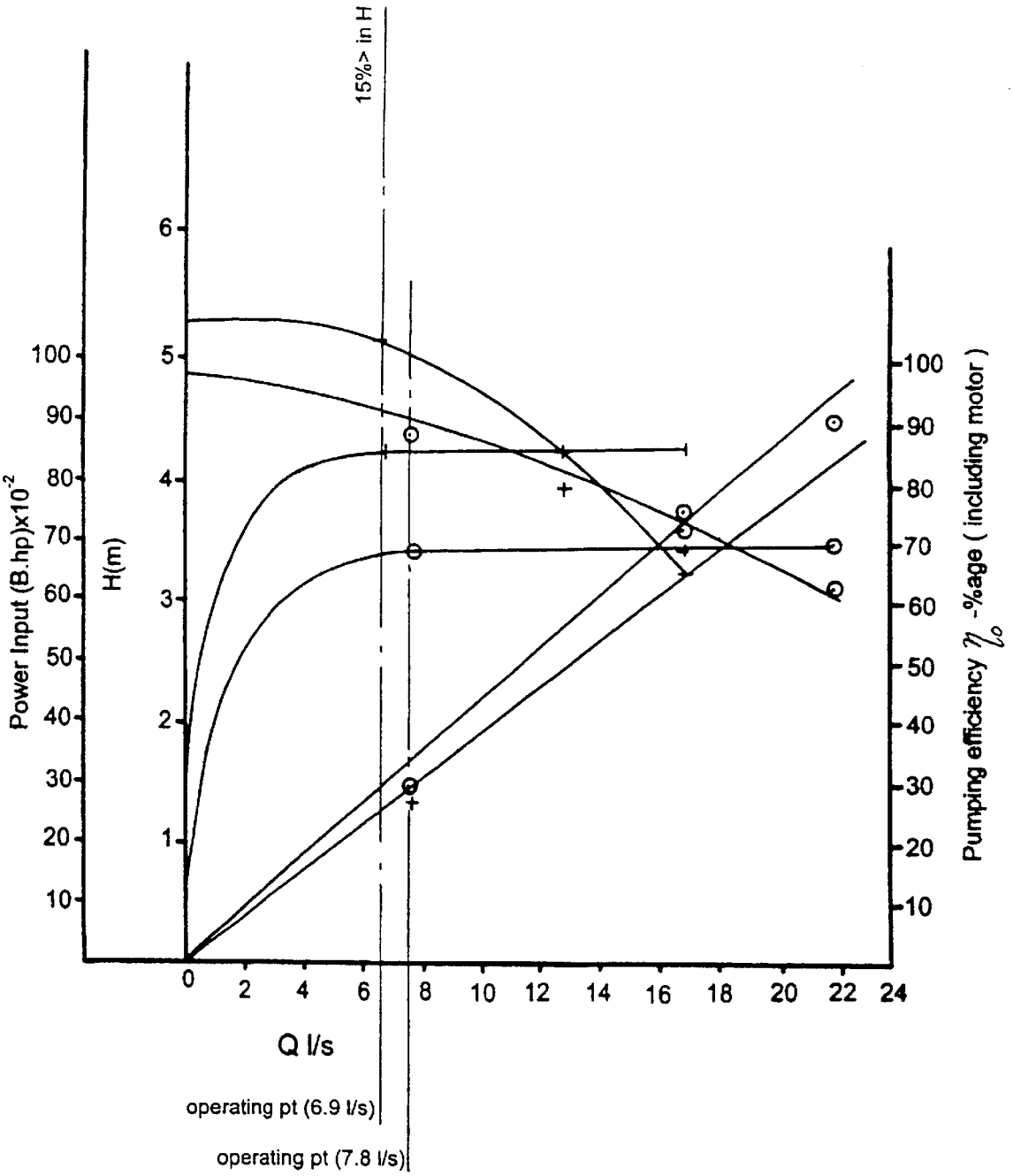
FIG. 17 is a plot of performance characteristics of test results conducted as herein after defined wherein a four nozzle unit with a nozzle diameter of 40 mm was used wherein the fluid prior to the pump had a suction head of 1 300 mm, for test pump B.
Figure 18:
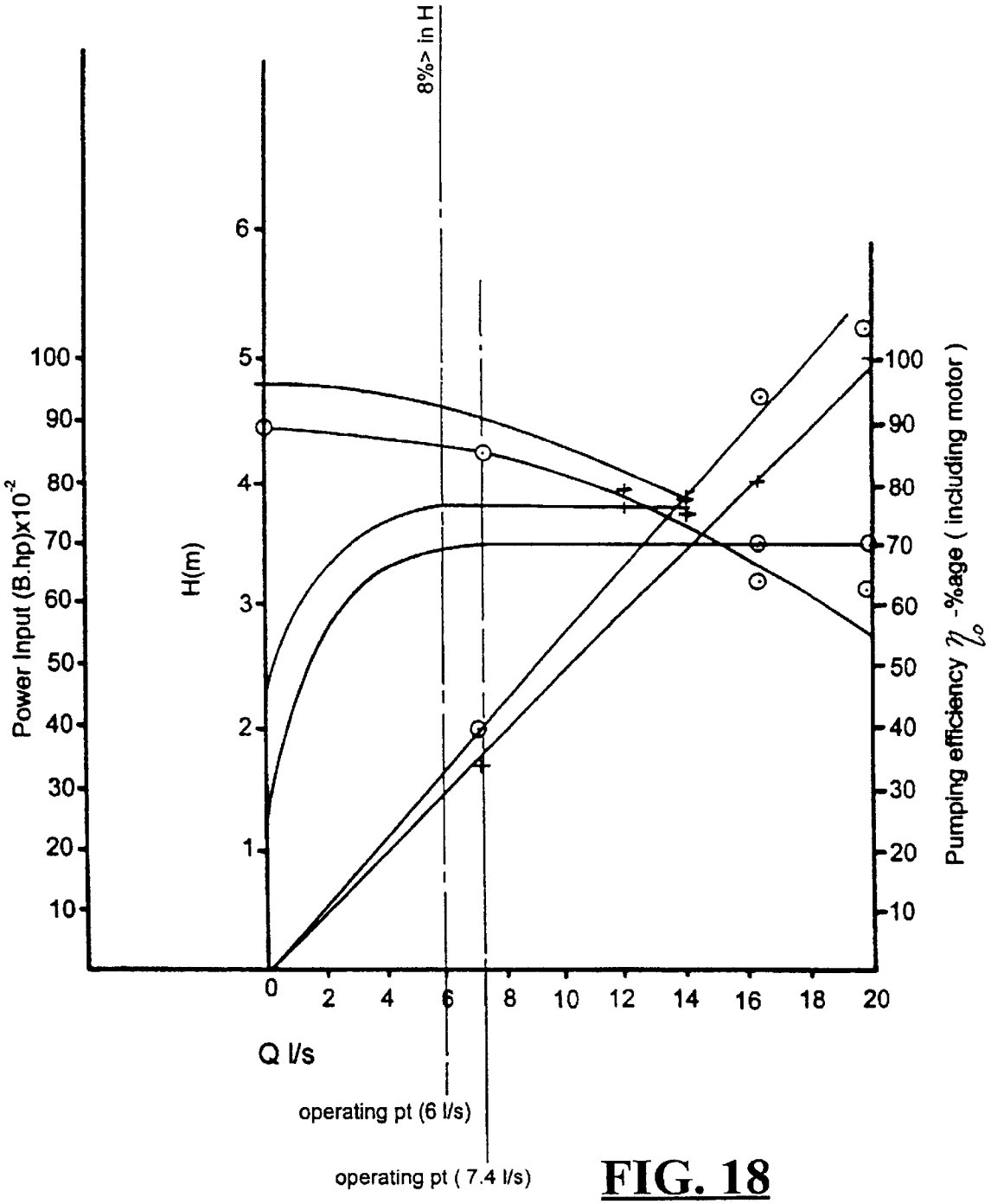
FIG. 18 is a plot of performance characteristics of test results conducted as herein after defined wherein a four nozzle unit with a nozzle diameter of 40 mm was used wherein the fluid prior to the pump had a suction head of 500 mm, for test pump B.

In the preferred form the reduction in cross-sectional area occurs at the nozzle unit immediately before the point of inlet into the suction flow for reason for which are herein after described. With reference to FIGS. 5–7 wherein there is shown in cross-section preferred configurations of nozzle units 5 wherein in FIGS. 5 and 6 the nozzle units have two nozzles and in FIG. 7 there are four nozzles. With reference to FIG. 9 there is illustrated the momenclature referred to herein in relation the dimensions $d_N$ and $d_B$ which are proportional to the area of the nozzle at its inlet and outlet and hence the velocity of fluid at each point is also dependent thereon. Preferably the cross-sectional flow area of the nozzles, inlet and outlet conduits and other conduits are substantially circular. Other shaped cross-sections may also be used.

In a broad sense the accelerated (i.e. increased kinetic energy) bleed fluid may be injected into the suction side of the flow at any angle. However in the preferred form such injection may occur at right angles to the flow direction (whether in a radial or tangential sense) and preferably occurs in a tangential direction. The preferred tangential injection of fluid is preferably achieved by a nozzle unit as by example shown in FIG. 5. Such injection reduces any losses as a result of the mixing of the main flow with the injected fluid. The preferred highly swept back design and preferred uniform flow of fluid through the nozzle will decrease such nozzle losses. In the preferred form of the invention, the injected fluid simultaneously imparts a rotatory flow (i.e. a swirl) to the flow of fluid prior to it reaching the impeller. This is preferably achieved by the tangential injection of fluid and can result in improved intake angles (i.e. the angle of incidence of fluid in respect of the impeller blades and may also have an effect on reducing the losses as a result of secondary flows).

For at least a centrifugal pump, action of centrifugal forces, caused by rotating blades, will create change in pressure on the suction side, which increases radially towards the pipe walls. The pressure distribution in planes perpendicular to the pipe or input flow axis ahead of the impeller defines (for equal pressure curves), a parabola which gets steeper in regions closer to the impeller. As particles of fluid get closer to the impeller, a rotational motion is created because the absolute velocities of these particles are the sum of both axial and radial components. This motion does not take place suddenly, but starts at a certain distance from the pump entrance. At a certain section ahead of the impeller, particles with axial motion change gradually to particles with rotational motion in vicinities closer to the impeller suction side. This change is accompanied by change in momentum from approximately zero to values equivalent to those particles near the impeller. The present invention preferably envisages the use of a plurality of nozzles although one nozzle may suffice in certain instances. Their location and number are matters to be determined by experimentation in relation to particular pump parameters and geometries so as to optimise effect and performance. Likewise with the control systems and/or the nature of the bleed streams. However with reference to the examples herein after described we have shown what has experimentally been found to be favourable conditions of operation for particular pumps and system parameters.

The bleed flow from the delivery side of the pump is transmitted via a bleeding means 2, through a connection conduit 1 to the suction side and with nozzled 6 entry results in injection of bled fluid into the suction side.

The conversion of pressure energy to kinetic energy between the point of bleeding at 2 from the discharge line to the suction line is preferably achieved at the nozzles substantially immediately prior to fluid injection into the suction line. This is preferably achieved by a tapering of the nozzles which with reference to FIG. 9 preferably has a ratio defined by $d_B/d_N$ occurring over a distance L, where $d_N$ and $d_B$ are the nozzle outlet and inlet diameter respectively and bleed conduit diameter and their respective areas are directly proportional to such diameter. It must however be appreciated that the bleed flow area need not necessarily be of a circular nature and may be of any suitable shape cross-section.

From experimentation we feel that the best improvement (or change in total head delivery ΔH) in head of a pump of the present invention compared to a conventional pump is where the ratios of $d_B/d_N$ and $d_B/d_L$ are substantially as follows:

$d_B/d_N$=2:1

$d_B/d_L$=1:2

We believe that these ratios are the preferred ratios independent of the number of nozzles, (i.e. means to inject) bleeding rate of flow ($Q_d$) and pump size.

EXAMPLE

As mentioned above it is desirable, in order to achieve the best performance, to experimentally investigate the flow of particular spec pump. This is hereinafter referred to as the calibration test. Armed with the insight gained is to predict the performance of new designs.

Both the optimal range of Bn and the value of N are determined from tests. Both Cd and Qw should then be calculated using given parameters for each specific pump which can then be used for different spec pumps.

The pumps selected represented three duties in which the operators can have cavitation troubles with conventional pumps. The conventional duties of the pumps used to describe the examples were:

| | A | B | C |
|---|---|---|---|
| Product | Water | Water | Water |
| Pumping temp. | Ambient | Ambient | Ambient |
| Specific gravity | 1.00 | 1.00 | 1.00 |
| Vapour press. | 2.55 × 102 kg/m$^2$<br>0.36 Psi Abs. | 2.55 × 102 kg/m$^2$<br>0.36 Psi Abs. | 52.8 × 102 kg/m$^2$<br>7.51 Psi Abs. |
| Capacity | 0.8 L/s | 20 L/s | 5 L/s |
| Differential head | 2 m | 4.5 m | 3.5 m |
| NPSH | 0.5 m | 1.5 m | 0.75 m |

The first item in the design process was to decide on the optimum diameter (dn) and the positioning of the nozzle unit on the suction side:

Example of Test Pump A (i) The Constant Head Water Tank:

It is an open tank: 1×0.7×2.2 cu.meters, elevated 100 mm from ground level. Delivery from tank at suction side is through a circular opening 27 mm in diameter. The tank is made of galvanised mild steel, 4 mm sheet thickness. A container of 20 liters is positioned near the top side of the tank to measure the volume of discharged water per unit time.

(ii) The Suction Line:

Is 297 mm long made of mild steel. The internal diameter is 27 mm. Arrangement for spacers with different lengths is provided to facilitate positioning of nozzle units at the desired distance from the impeller. Suction valve is mounted at a distance of 85 mm from the tank edge.

(iii) The Pump:

It is a model pump with a centrifugal impeller and single discharge volute. There is a conical diffuser at the higher-pressure end of the pump. The pump has the following dimensions:

| | |
|---|---|
| $r_1$ = 10 mm, $r_2$ = 30 mm | $b_1$ = 8 mm, $b_2$ = 12 mm |
| Number of vanes = 7 | Model No.: 45-00701-01 |
| Manufacturer: AETTS-Australia | |
| H (head) = 2 m at | Q (discharge) = 0.8 L/s |

(iv) The Electric Motor:

The drive motor is asynchronous and runs at the very nearly constant speed of 1400 r.p.m, with the following characteristics:

| | | | |
|---|---|---|---|
| Horse power HP = ⅓, | Phase = 1, | Amperes = 1.1, | Hertz Hz = 50, |

Voltmeter/ammeter is used to measure the voltages and currents consumed.

(v) Temperature Detector:

Made use of a mini-surface detectors, having a measuring range between (−50° C.) up to (+250° C.). Readings at suction and delivery sides were recorded for each experiment.

(vi) The Nozzle Units:

Nozzles on the suction side of each test, are made of aluminum so that the effect of corrosion and abrasion on the change of friction losses would be negligible. The following table gives the dimensions of the used nozzles:

Dimensions of nozzle units used with pump A

| | No of nozzles (N) | Bleed pipe diam. to nozzle ($d_B$) mm | Nozzle head diam. ($d_n$) mm | Length of taper ($L_n$) mm |
|---|---|---|---|---|
| a | 2/4 | 3 | 1.5 | 6 |
| b | 2/4/two series | 6 | 3 | 12 |
| c | 2/4/two series | 12 | 6 | 24 |
| d | 4 | 12 | 3 | 24 |
| e | 2/4/two series | 19 | 9.5 | 38 |
| f | 2/4 | 19 | 4 | 38 |

Figure 2:
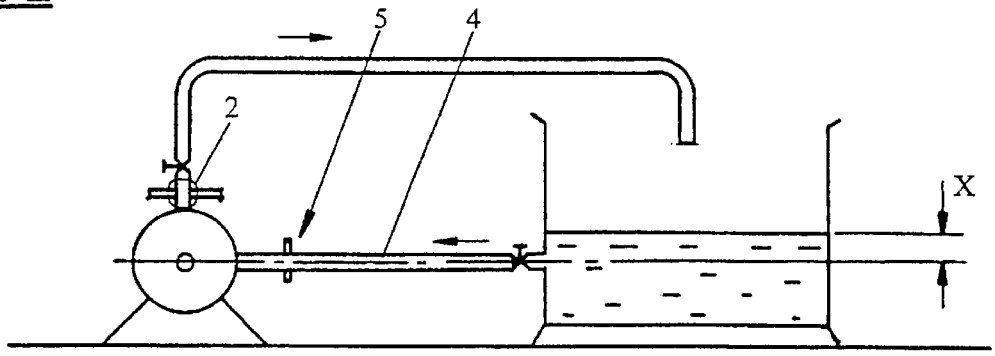
FIGS. 2–4 illustrate arrangements which by way of experimental results are explained herein, wherein pump is placed in respect to a fluid source reservoir which for FIGS. 2 and 3 provide a suction head of 105 mm and 557 mm respectively and a suction lift for FIG. 4 of 875 mm.
Figure 3:
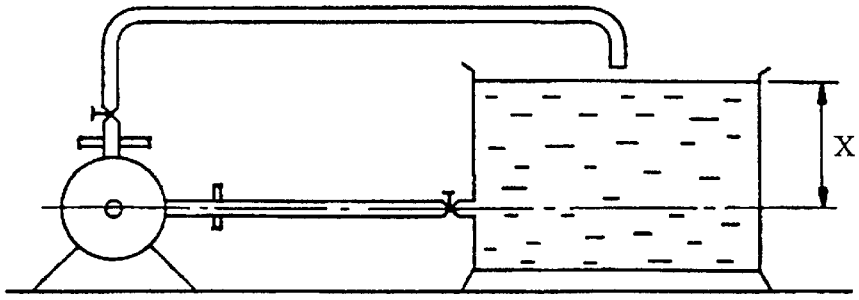
Figure 4:
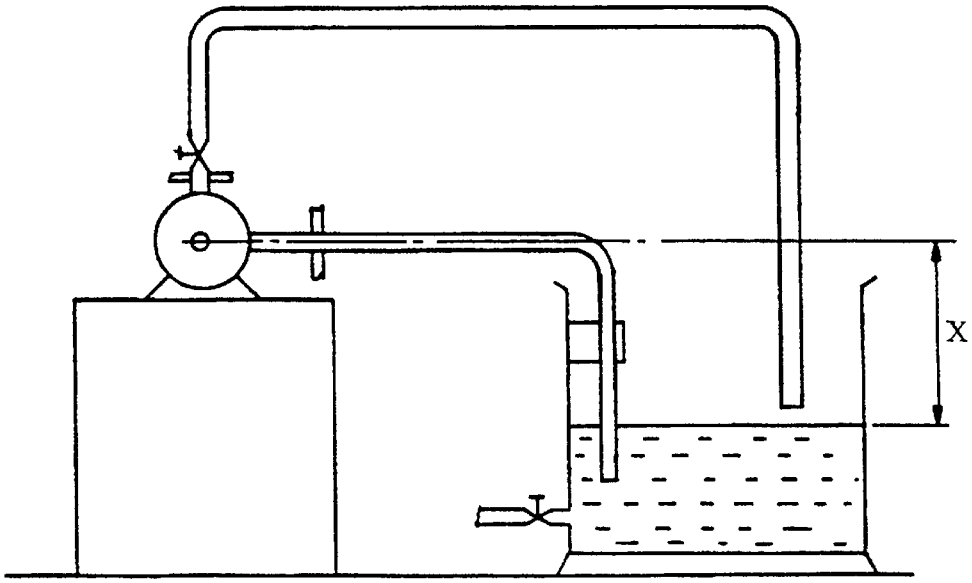

(vii) The Discharge Line:

It is 2.620 m long (for positions x (see FIGS. 2, 3)105 and 557 mm), and 4.558 m long (for suction lift position see FIG. 4). Pipe is made of PVC, 3 mm thick, and with internal diameter of 25 mm. The discharge valve is located at a distance of 300 mm from pump exit.

Calibration Test for Pump A

These tests were performed to study the behavior of the pump performance using bleeding system from the delivery side to suction side. Tests were performed in steady, non pulsating conditions, and almost constant temperature. The variables in the test were a) the nozzle number N b) the nozzle diameter $d_B$ c) the suction dop/lift d) delivery valve position e) bleed valve position (and hence $Q_d$)

f) the upstream position of the nozzle from the impeller.

g) swirl direction of suction flow

The tests for pump A involved three positions X, pump: (refer to FIG. 2–4)

When level of water tank is 105 mm above the suction valve. When level of water tank is 557 mm above the suction valve.

With a suction lift of 875 mm from centre of suction pipe.

Two types of nozzle units were used in the first test. These were:

2 nozzles×3 mm $d_B$ 4 nozzles×3 mm $d_B$

Each of these units was tested to find the optimum resolutions, when working on the following parameters:

Delivery valve: Fully open, ½ open, ¼ open, and fully shut.

Bleeding valves: Fully closed, fully open, ½ open, and ¼ open.

Nozzle position from impeller: 68 mm, 85 mm, 100 mm, 125 mm, and 200 mm.

Direction of rotation of flow from nozzle included rotation in the same direction as that of the impeller, and another against the direction of rotation of the impeller.

In the second group of tests, four types of nozzle units were used. These were:

2 nozzles×6 mm $d_B$ 4 nozzles×6 mm $d_B$

2×2 nozzles in series [at 15, 40, and 60 mm apart]×6 mm $d_B$

2×4 nozzles in series [at 15, 40, and 60 mm apart]×6 mm $d_B$

Each of these units was tested in the following positions and combinations:

Delivery valve: Fully open, ½ open, ¼ open, and fully shut.

Bleeding valves: Fully shut, fully open, ½ open, and ¼ open.

Nozzle position from impeller: 65 mm, 85 mm, and 100 mm.

Direction of rotation of flow from nozzle: With the same direction of rotation as that of the impeller.

(C) In the third group of tests, five types of nozzle units were tested. These were:

2 nozzles×12 mm $d_B$ 4 nozzles×12 mm $d_B$

2×2 nozzles in series [at 40 mm apart]×12 mm $d_B$

2×4 nozzles in series [at 40, and 80 mm apart]×12 mm $d_B$ 4 nozzles×12 mm (3ϕ) dB Each of these units was tested in the following positions and combinations:

Delivery valve: Fully open, ½ open, ¼ open, and fully shut.

Bleeding valves: Fully shut, fully open, ½ open, and ¼ open.

Nozzle position from the impeller: 65 mm.

Direction of rotation of flow from nozzle: With the same direction of rotation as that of the impeller.

(d) In the fourth group of tests, six types of nozzle units were tested. These were:

2 nozzles×19 mm dB 4 nozzles×19 mm dB

2×2 nozzles in series [at 40, and 80 mm apart]×19 mm dB

2×4 nozzles in series [at 40, and 80 mm apart]×19 mm dB 2 nozzles×19 mm (4ϕ) $d_B$ 4 nozzles×19 mm (4ϕ) $d_B$ Each of these units was tested in the following positions and combinations:

Delivery valve: Fully open, ½ open, ¼ open, and filly shut.

Bleeding valves: Fully shut, fully open, ½ open, and ¼ open.

Nozzle position from the impeller: 65 mm.

Direction of rotation of flow from nozzle: With the same direction of rotation as that of the impeller.

Test Observations

The following observations were derived from the calibration test for pump A:

(1) Direction of Rotation of Flow from Nozzle Unit:

The analysis of data for both positive (with the direction of impeller motion) and negative (against the direction of impeller motion) rotations of flow from nozzle units demonstrated an appreciable pressure detection when compared to conventional pumping. On the other hand, the Head-Discharge characteristics was found to be higher in the case of positive rotation as compared to negative rotation, affirming more stable conditions, and reduced separation at entrance of the impeller.

(2) Location of Nozzle Units Ahead of the Impeller:

Test results showed that better values for ΔH are reached with nozzle unit approaching closer to the impeller. This can be explained by the fact that, as the particles of rotating fluid get closer to the impeller, the absolute velocity, being the sum of both the axial and radial components of the rotating flow, is increased due to the influence of centrifugal forces caused by rotating blades. Consequently, creating a higher change in pressure on the suction side.

(3) Shape and Design Dimensions for the Nozzle Unit:

The role of the nozzle has been made easier by giving it the best shape to achieve the highest possible ΔH. A single 4 nozzle unit gave the best increase in ΔH. Using this shape the mixing process ensured a reasonable uniform flow to the impeller. This was in contrast to other shapes in which substantial losses occurred inside the nozzle channels, giving lower values of ΔH.

Optimum dimensions recommended for the nozzle shape dB: $d_N$=2:1 dB: L=1:2

Test Facilities for Pump (B)

Constant Head Water Tank:

Delivery from tank at suction side is through a circular opening of 100 mm diameter. A container of 150 liters is positioned at the top of the discharge tank. The container dimensions is 750 mm ϕ×960 mm height, made of polyethylene. Two pipes are connecting both tanks. The pipes has the following dimensions:

| | | | | |
|---|---|---|---|---|
| Diameters: | (1) 96 mm<br>(2) 150 mm | Lengths: | (1) 1410 mm<br>(2) 1456 mm | material: mild steel |

The Suction Line:

Is 621 mm long made of mild steel with internal diameter of 103 mm and 6 mm thickness. A suction valve is mounted at a distance of 225 mm from the tank edge.

The pump:

A single stage mixed flow pump. The pump has the following dimensions:

| | |
|---|---|
| $r_1$ = 30 mm, $r_2$ = 60 mm | $b_1$ = 90 mm, $b_2$ = 90 mm |
| Number of vanes = 7 | Model No.: UniBloc, 80-169 |
| Manufacturer: Applied Pumping Technologies LTD (APT) | |
| Serial No: J787 | |
| H (head) = 4.5 m at NPSH = 1.5 m | Q (discharge) = 20 L/s |

The Electric Motor:

Runs at a constant speed of 1390 r.p.m, having the following characteristics:

| | |
|---|---|
| Horse power HP = 2, Phase = 3, Amperes = 0.2, | Hertz Hz = 50, |
| Voltmeter/ammeter detector reads = 230 V | Kw = 1.5 |
| Manufacturer: CEG - Italy, MOT 3IEC34 | No: 0229912 |

The Nozzle Unit:

Four nozzles, $d_B$=40 mm, $d_N$=20 mm, and L=80 mm.

The Discharge Line:

It is 4775 mm long (for positions 500 mm and 1300 mm), and 3895 mm long (for suction lift position). Pipe is made of mild steel, 5 mm thick, and with internal diameter of 79 mm. The discharge valve is located at a distance of 395 mm from pump exit.

(viii) Pressure Gauge/Manometer:

Open tube manometers were used to measure the pressure head at the suction side. Gauge manometers were used in measuring the pressure head at the delivery side. The gauge was placed at a distance of 650 mm from the pump exit. The gauge was ranged from 0–2.5 bars.

Calibration Test for Pump (B)

Tests were performed to study the behavior of the pump performance using bleeding system from the delivery side to suction side. Tests were performed in steady, non pulsating conditions, and almost constant temperature. Re-cords showed a negligible rise in temperature between the suction and delivery flows, in average not exceeding 0.5° C. One effect could be the hot air discharged from the pump electric motor and directed towards the pump impeller. Motor was operating at the service factor horsepower.

The tests involved three positioning of pump:

When level of water tank is 500 mm above the suction valve.

When level of water tank is 1300 mm above the suction valve.

With a suction lift of 1500 mm from centre of suction pipe.

The dimensions of the nozzle unit is:

4 nozzles×40 mm dB×20 mm dN×80 mm L

The nozzle unit was tested for the following parameters:

Delivery valve: Fully open, ½ open, ¼ open, and fully shut.

Bleeding valves: Fully closed, fully open, ½ open, and ¼ open.

Nozzle position from impeller inlet: 130 mm.

Direction of rotation of flow from nozzle: The same direction of rotation as that of the impeller.

Test Facilities for Pump (C)

The same test facilities used for pump (B) were also used for pump (C), with the following modifications:

Constant Head Water Tank

Delivery from tank at suction side is through a circular opening of 63 mm diameter.

The Suction Line:

Is 477 mm long made of mild steel with internal diameter of 63 mm and 4 mm thickness. A suction valve is mounted at a distance of 225 mm from the tank edge.

The Pump:

A single stage centrifugal glanded pump, having the following dimensions:

| | |
|---|---|
| $r_1$ = 30 mm, $r_2$ = 60 mm | $b_1$ = 8 mm, $b_2$ = 10 mm |
| Number of vanes = 7 | Model No.: EV6-1601150 |
| Manufacturer: Perfecta - D.M. Wallace LTD | |
| Type: NCP 6 - 125 | |
| H (head) = 3.5 m at | Q (discharge) = 5 L/s |
| NPSH = 0.75 m | |

The Electric Motor:

Runs at a constant speed of 1450 r.p.m, having the following characteristics:

| | |
|---|---|
| Horse power HP = 0.4, Phase = 3, Amperes = 3.5, | Hertz Hz = 50, |
| Voltmeter/ammeter detector reads = 405 V | Kw = 0.3 |
| Manufacturer: Perfecta - D.M. Wallace LTD | |
| No: 39277/300 4/230/400 | Type: BGP6 - 125 |

The Nozzle Unit:

Four nozzles, $d_B$=25 mm, $d_N$=12.5 mm, and L×50 mm.

The nozzle unit is placed at a distance of 230 mm from pump centre.

The Discharge Line:

It is 4385 mm long (for positions 500 mm and 1300 mm). The pipe is made of mild steel, 4 mm thick, and with internal diameter of 63 mm. The discharge valve is located at a distance of 290 mm from pump exit.

Pressure Gauge/Manometer

Open tube manometers were used to measure the pressure head at the suction side. Gauge manometers were used in measuring the pressure head at the delivery side. The gauge was placed at a distance of 440 mm from the pump exit.

Calibration Test for Pump (C)

The tests involved two pump positions

When level of water tank is 500 mm above the suction valve.

When level of water tank is 1300 mm above the suction valve.

The nozzle unit was tested for the following parameters:

Delivery valve: Fully open, ½ open, ¼ open, and filly shut.

Bleeding valves: Fully closed, fully open, ½ open, and ¼ open.

Nozzle position from impeller centre: 230 mm.

Direction of rotation of flow from nozzle: The same direction of rotation as that of the impeller.

6. Test Results and Performance Characteristics

The three pumps were tested at Unitec Laboratories. Details of these pumps are:

| Pump | | A | B | C |
|---|---|---|---|---|
| Inlet diameter | mm | 20 | 60 | 60 |
| Flow | L/S | 0.5 | 20 | 5 |
| Cent. tip | mm | 60 | 120 | 120 |
| Diameter Head | m | 2 | 4.5 | 3.5 |

FIGS. (20–22) shows the optimum bleeding required at three different positions[875 mm suction lift, 557/105 mm suction head] using different shapes of nozzle units. It was found that the optimum bleeding occurred in the range between $B_N$=0.03–0.04 It was also noticed that the flow tends to be unstable as the Bleeding Number values approach $B_N$=1.

Complete characteristic curves including the head flow, efficiency, and break-horsepower characteristics for the conventional and new arrangement of pumps: A (using best nozzle arrangement of: 4N×12 mm $d_B$), B (using nozzle unit: 4N×40 mm $d_B$), are shown in FIGS. 13–18. The efficiency given is the overall pump efficiency including motor, which means a peak efficiency of 80 percent for pump A, 86 percent for pump B, as compared with conventional pumps of 70 percent, 70 percent.

Figure 19:
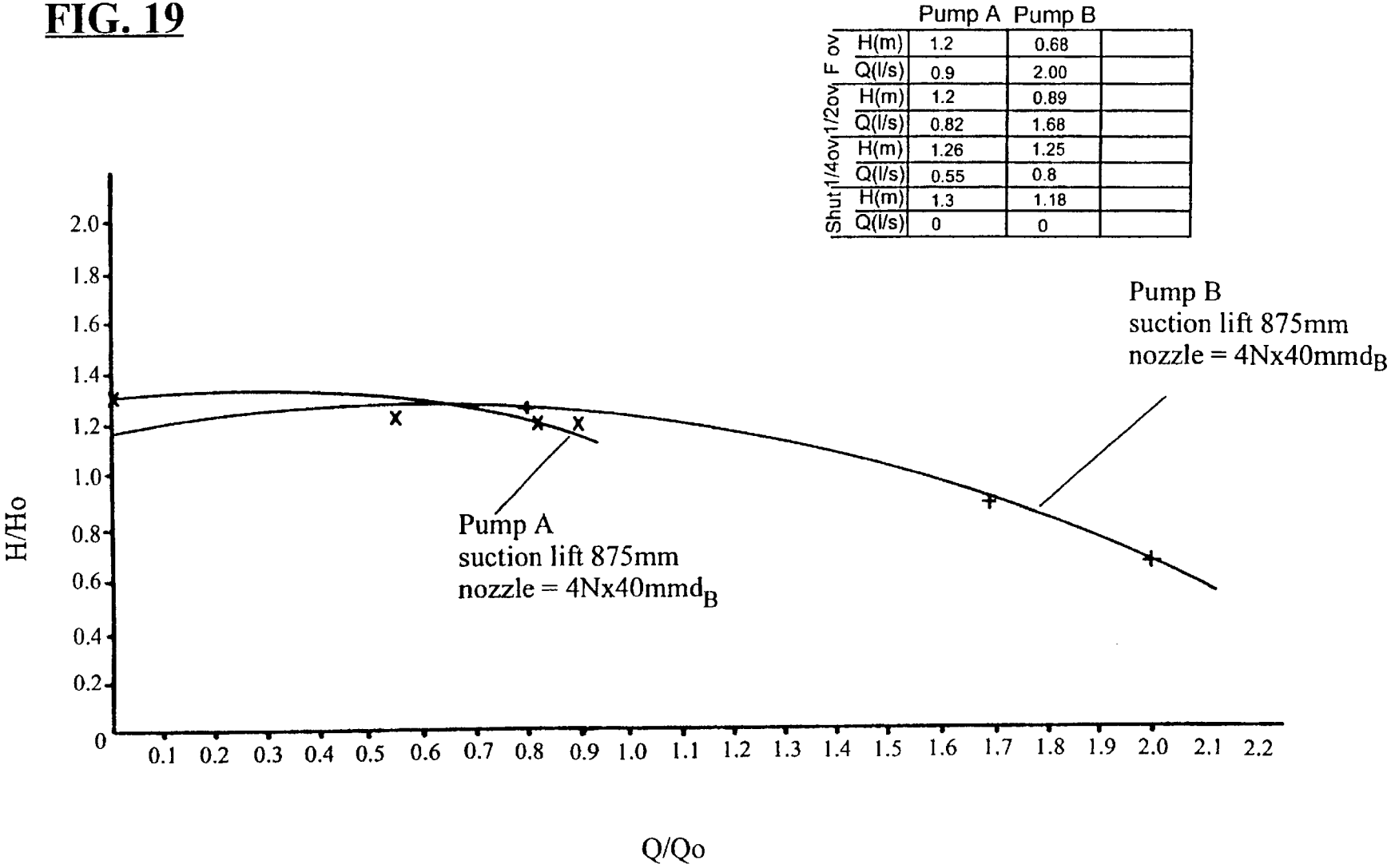
FIG. 19 is a plot of relative performance of pumps A and pumps B as herein described as part of the testing as a non dimensional comparison with both head and flow rates in respect of a conventional pump.
Figure 20:
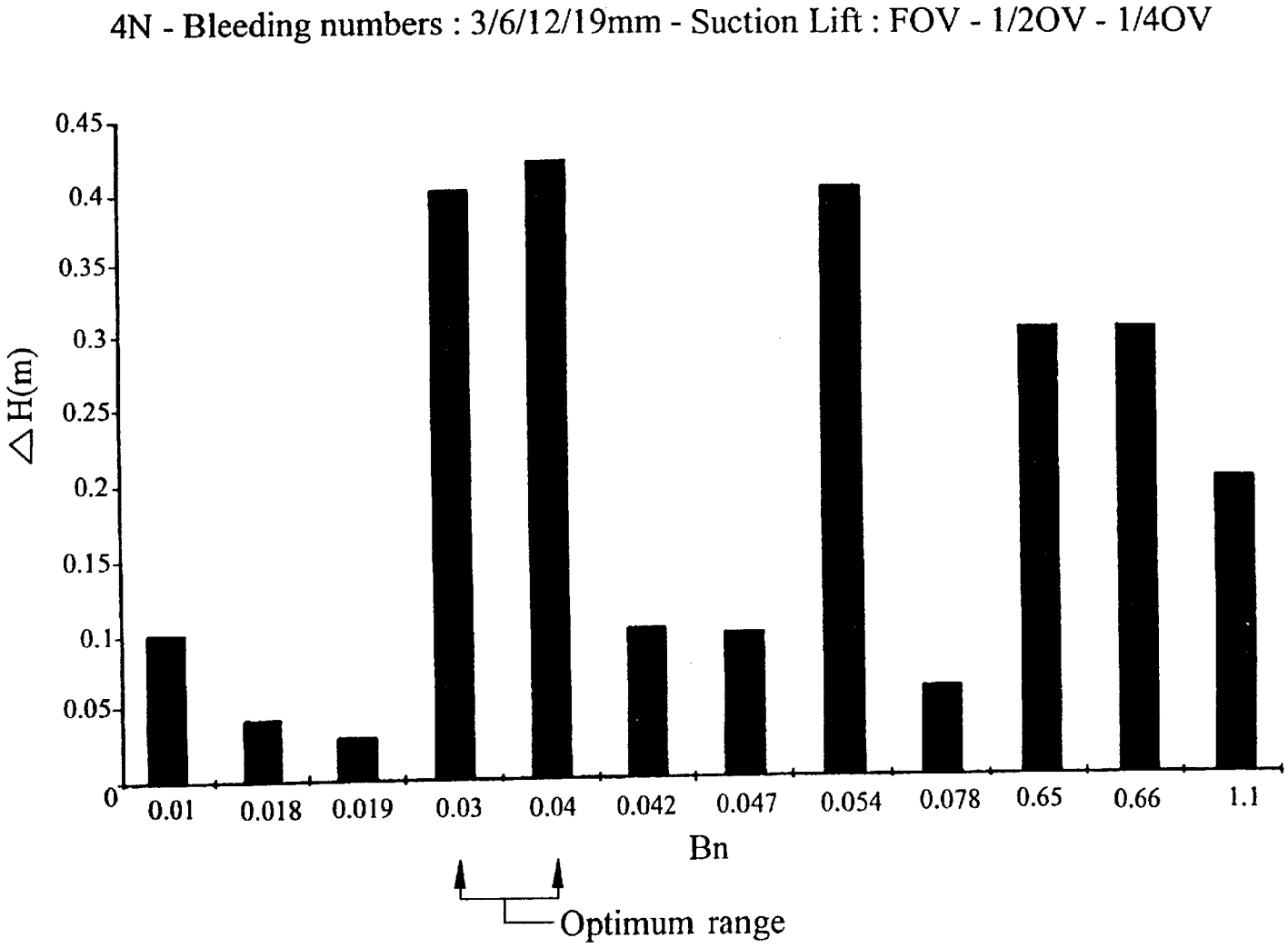
FIGS. 20–23 show the optimum bleeding required at three different positions (875 mm suction lift, 557 mm suction head) using different shapes of nozzle units.
Figure 21:
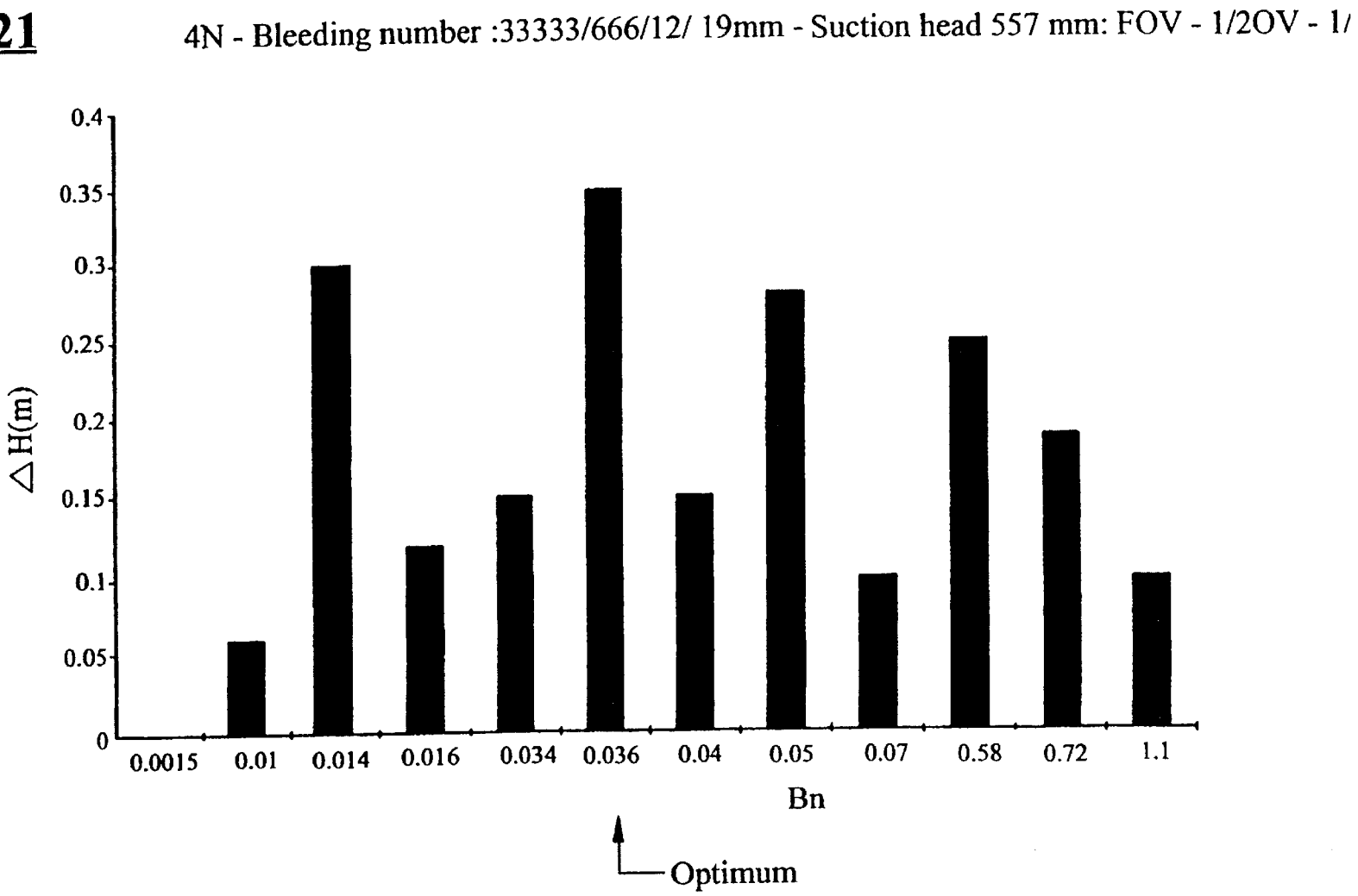
Figure 22:
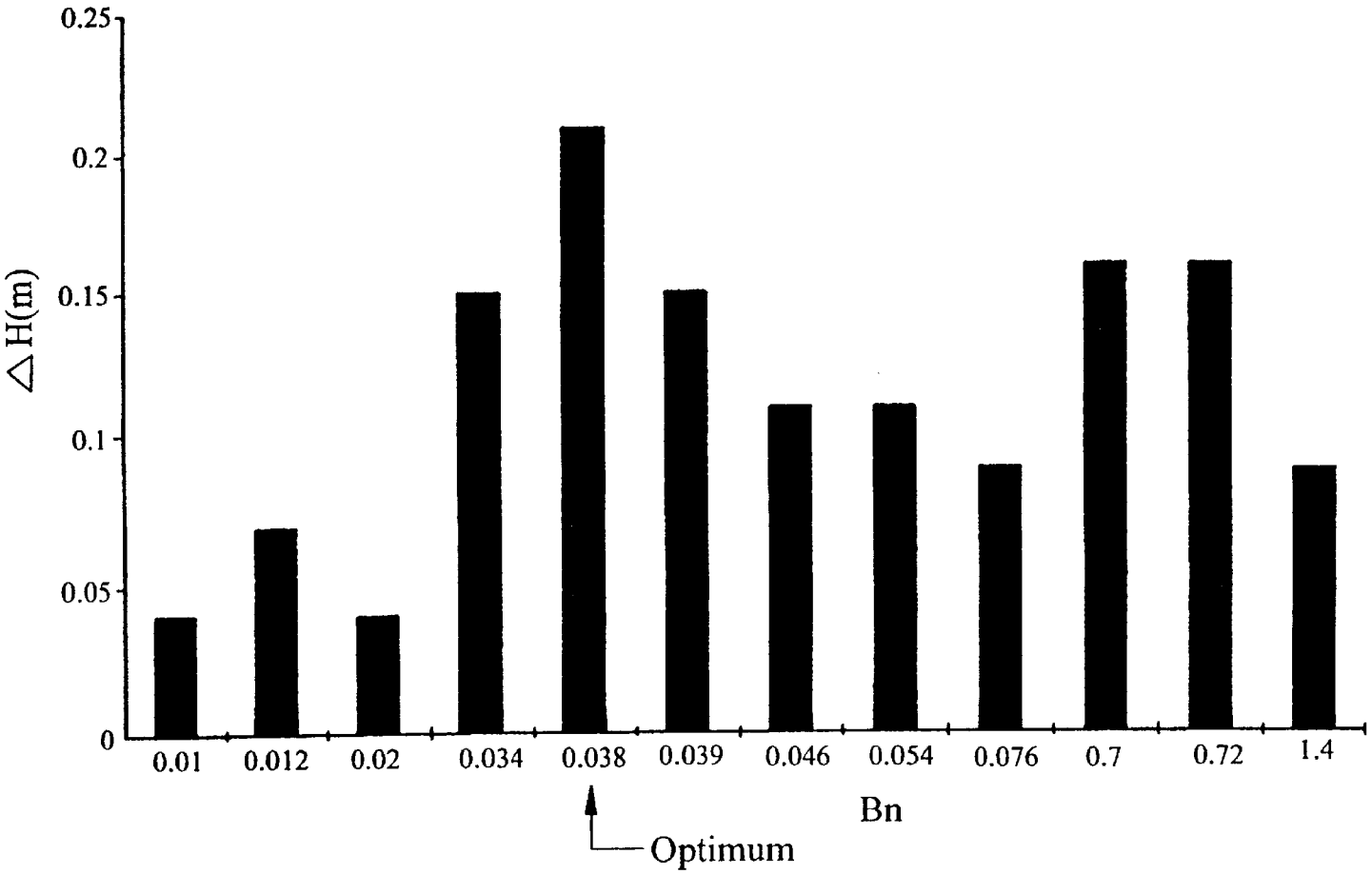
Figure 23:
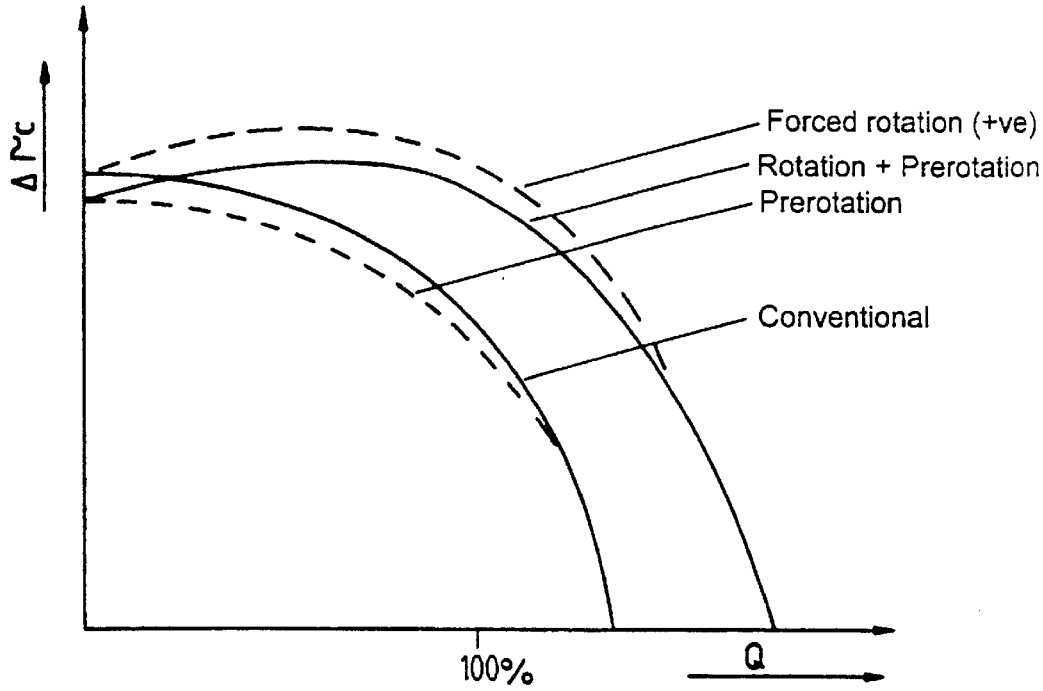

The relative performance of the three pumps are shown by a non-dimensional comparison in FIG. 19, where both head and flow are related to conventional pump operating (duty) points head ($H_0$) and flow ($Q_0$). It can be seen that pumps A+B have substantially similar characteristics. As would be expected pump (B) has a larger operating range.

Application of bleeding system using a suitable nozzle arrangement unit placed on the suction side, has allowed for the first time the control of the pump characteristics from the suction side. Comparison between conventional and new pump application suggest how effective the bleeding units are. The inequalities of pressure head have now been smoothed out, the overall energy loss has in this instance been reduced, and the ideal useful lift has risen from 2.1 to 2.55 m for pump (A), from 4.4 to 5.5 m for pump (B), and from 2.27 to 3.1 m for pump (C) without increase of energy input. The pump efficiencies has also increased in average from 70 to 82.6 percent.

The pump used in test has a centrifugal impeller and single discharge volute. The pumps head (H) is 2 meters at discharge (Q)=0.8 L/s. The pump was tested in three basic levels relative to the water level inside the tank (105 mm, 557 mm suction head, and 875 mm suction lift). Eleven different combinations of bleeding nozzle units having diameter between 3 to 19 mm were used for testing pump (A).

Test results showed that the conventional pump efficiency was 70 percent when operating under rated conditions, and require 0.26 hp to drive it. The new pump, at optimum bleeding, gave an efficiency of 80 percent and requires only 0.22 hp. That is to say, there is a 10 percent increase in overall efficiency with a 16 percent reduction in power.

The new pump rated capacity was found to have a value of 0.98 L/s at the same pumping conditions of the conventional pump which is rated at 0.73 L/s. It would take the new pump 2.8 hrs to fill a tank of 10×103 liters, and 3.8 hrs to fill the same tank using the conventional pump, a saving of one hour.

The maximum value for the bleed causing the rotation ahead the impeller on the suction side may be determined by the dimension less group referred to herein as the Bleed number $B_N$:

$$\frac{Qd}{Qw} = \frac{NACd}{Qw} = B_N$$

The basic assumption of the dimensionless group (Bleeding Number) is:

$$B_N = NAC_d/Q_W \quad (1)$$

Where, N=Number of nozzles used.

Greater ranges of control is expected when compared with effect of rotating action alone.

Figure 24:
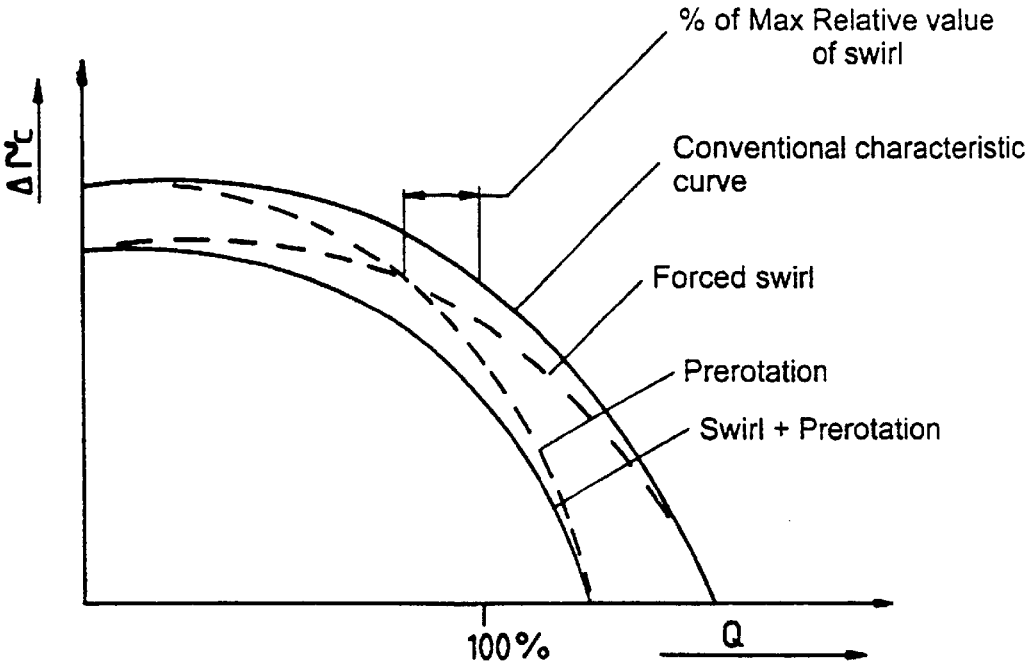

FIG. 24 represents trends of having both forced rotation and a natural pre-rotation ahead of the impeller. Both the forced and pre-rotation curves are best determined experimentally.

Theoretically, pressure due to rotation could, in approximation, be calculated for radial pumps as follows:

$$\Delta p_1 = \rho(u_2 C_{2u} - u_1 C_{1u}) \quad (2)$$

and for axial pumps:

$$\Delta p_1 = \rho u(C_{2u} - C_{1u}) \quad (3)$$

where, $$u_1 = u_2 u$$

and, the circumferential velocity $C_{u1}$ could, in approximation, be calculated from the principle of momentum as follows:

$$\rho Q_d C_d R_d = \rho \int 2\pi R\ dr\ C_a . C_u . R \quad (4)$$

Taking distribution of velocity ahead an axial impeller to follow, in approximation, the free vortex principle:

$$R\ C_u = \text{constant} \quad (5)$$

Similarly, for radial impeller:

$$R_1 C_{1u} = \text{constant} \quad (6)$$

Substituting, we get for axial impeller:

$$Q_d Cd\ R_d = C_u R \int 2\pi R\ d_r C_a = Q_w C_u R$$

Where, $R_d$=distance from axis of nozzle to axis of impeller. Similarly, for radial impeller we get:

$$Q_d C_d R_d = Q_w R\ C_{1u}$$

$C_{1u}$: is the circumferential velocity which should be checked on experimental basis.

To design a new type of pump we need to know, with aid of practical measurements, values for the following:

1. Circumferential velocity $C_{2u}$ using the relation:

$$P_c - P_b - P_m = \omega M_k = \omega \rho Q_w R_s C_{2u}$$

Where, $P_b$=Power lost due to secondary flow inside the fluid $P_m$=Mechanical power loss $R_s$=½ ($Rin^2 - Rex^2$)

$C_{2u}$: means the increase in circumferential velocity with raduis R dividing stream volume entering an axial impeller. For radial impeller we have, $$R_s = R_2 \text{ and } Q_w = Q + Q_d$$

2. $C_{1u}$: The circumferential (whirl) velocity at entrance for axial impeller calculated on radius R dividing the stream volume, which can be determined from the relation:

$$Q_w R_1 C_{1u} = Q_d C_d R_d$$

3. $C_d$: exit velocity from nozzle, influenced by value of losses taking place inside the control valves, can be determined from the relation:

$$C_d = \phi\sqrt{2\Delta p/\rho}$$

Where, $\Delta p = p_a - p_1$

A more accurate relation, where the value Δp is decreased by an amount $\Delta p_2$ equivalent to loss in pressure inside the control valves and coefficient of flow $\phi_2$ is suggested from actual values in practice, we then get the relation:

$$C_d = \phi^2\sqrt{2/\rho(\Delta p - \Delta p_2)}$$

The ratio of $\phi/\phi_2$ is an indication of the control valve system performance.

4. Influence of rotation on centrifugal pumps with a whirl ahead of the impeller can be found by applying the relation:

$$(u_2 C_{2u} - u_1 C_{1u})\rho = \Delta pt$$

Knowing the value of $C_{1u}$ the theoretical increase in pressure (rotation) can be easily calculated. With the aid of velocity triangles, losses and useful pressures can be determined.

What is claimed is:

1. A pumping system comprising means defining a pump having an inlet and an outlet, an inlet conduit connected to said inlet of said pump for the inlet flow of fluid to said pump, a delivery conduit connected to said outlet of said pump for the outlet flow of fluid from said pump, means adapted to bleed at least part of the outlet flow as a bleed flow, means to independently deliver said bleed flow to each of at least two spaced means to inject the bleed flow int the inlet conduit, means capable of increasing a total velocity head of bleed flow to inject said bleed flow into said inlet flow to said pump at a total velocity head higher than the total velocity head of bleed flow at said means adapted to bleed.

2. The pumping system as claimed in claim 1, wherein said means to deliver is a conduit.

3. The pumping system as claimed in claim 2, wherein said means capable of increasing the total velocity head is provided by a reduction of total cross-sectional flow area of said means to deliver to thereby increase the velocity pressure head of said bleed flow prior to being injected into said inlet conduit.

4. The pumping system as claimed in claim 1, wherein each said means to inject is at least one nozzle in fluid connection via a designated and independent conduit with said means adapted to bleed.

5. The pumping system as claimed in claim 4, wherein each designated and independent conduit is controlled by at least one bleed flow control valve.

6. The pumping system as claimed in claim 4, wherein said means capable of increasing the total velocity head is provided at said at least one nozzle in the form of a reduced total cross-sectional flow area for bleed flow through said at least one nozzle.

7. The pumping system as claimed in claim 4, wherein said at least one nozzle comprises a passage for fluid with an inlet for bleed flow to be received from said means adapted to bleed via each said designated and independent conduit and an outlet connected for bleed flow delivery to said inlet conduit, wherein said inlet of each said nozzle is of greater cross sectional area than said outlet of said nozzle.

8. The pumping system as claimed in claim 7, wherein said passage of each said nozzle is gradually tapered over the length of said passage between said nozzle inlet and said nozzle outlet such that the cross sectional flow area of said outlet is smaller than the cross sectional flow area of said inlet of said nozzle.

9. The pumping system as claimed in claim 7, wherein the ratio of said cross sectional flow area of each said nozzle inlet to the cross sectional area of said nozzle outlet is substantially four.

10. The pumping system as claimed in claim 7, wherein said passage of each said at least one nozzle is substantially circular in cross sectional area and the ratio of inlet diameter to outlet diameter is substantially two.

11. The pumping system as claimed in claim 10, wherein the ratio of the length of said passage to the diameter of said nozzle inlet is substantially two.

12. The pumping system as claimed in claim 4, wherein each said at least one nozzle is engaged with said inlet conduit to, in use inject bleed flow into the inlet conduit through said nozzle outlet at substantially right angles to the main flow direction of fluid in said inlet conduit.

13. The pumping system as claimed in claim 4, wherein each said at least one nozzle is engaged with said inlet conduit to, in use inject bleed fluid into the inlet conduit through said nozzle outlet to induce a rotational flow to inlet flow of fluid approaching said pump.

14. The pumping system as claimed in claim 4, wherein there are four nozzles for injecting fluid into said inlet conduit.

15. The pumping system as claimed in claim 4, wherein each said nozzle is positioned a same distance upstream of said pump.

16. The pumping system as claimed in claim 4, wherein each said nozzle is equi-spaced about a perimeter of said inlet conduit.

17. The pumping system as claimed in claim 4, wherein each said means to inject is a nozzle in fluid connection via a designated and independent conduit with said means adapted to bleed, said at least one nozzle is engaged with said inlet conduit to in use inject bleed fluid into the inlet conduit through the outlets of said nozzles to induce a rotational flow to inlet flow of fluid approaching said pump co-rotatory with the rotational direction of the pump impeller.

18. The pumping system as claimed in claim 1, wherein said pump is a centrifugal pump.

19. A nozzle unit for injecting fluid into the main inlet flow stream of a pump comprising:

a conduit section capable of insertion into the main inlet conduit defining the flow boundary to said inlet flow stream of said pump, said conduit section comprising an inlet, an outlet, a wall defining region between said inlet and outlet to, in use, provide a substantial continuation of the boundary to the main inlet flow stream of fluid, and at least one aperture through said wall defining region, an injection nozzle for said at least one aperture to in use deliver a fluid bleed from the outlet flow of said pump into said inlet flow stream, said injection nozzle being a conduit having an inlet and an outlet, said outlet being at said wall defining region wherein the flow area of said inlet to said conduit is larger than said outlet of said conduit.

20. The nozzle unit as claimed in claim 19, wherein said conduit of said nozzle is secured to said conduit section such that in use the flow path of injected fluid at said outlet to said conduit is at substantially right angles to the main inlet flow stream of said pump.

21. The nozzle unit as claimed in claim 19, wherein said wall defining region of said conduit section is defined by a substantially constant diameter bore corresponding to the diameter of said main inlet conduit.

22. The nozzle unit as claimed in claim 19, wherein said conduit of said nozzle is secured to said conduit section such that in use the flow path of injected fluid at said outlet to said conduit is at substantially right angles to the main inlet flow stream of said pump and at a tangent to said boundary of said main inlet conduit.

23. The nozzle unit as claimed in claim 19, wherein said inlet of the conduit of said nozzle is of a flow area substantially four times that of the flow area of the outlet to said conduit.

24. The nozzle unit as claimed in claim 19, wherein said conduit of said nozzle is in cross section substantially circular.

25. The nozzle unit as claimed in claim 24, wherein said conduit is gradually tapered between said inlet and said outlet over a distance substantially twice that of the diameter of said inlet to said conduit.

26. A pumping system comprising:

means defining a pump having an inlet and an outer, an inlet conduit connected to said inlet of said pump for inlet flow of fluid to said pump, a delivery conduit connected to said outlet of said pump for outlet flow of fluid from said pump, means adapted to bleed at least part of the outlet flow as a bleed flow, said inlet conduit including a nozzle unit positioned upstream of said inlet of said pump, means to deliver said bleed flow to said nozzle unit, said nozzle unit including at least one means to inject the bleed flow into the inlet conduit, means capable of increasing a total velocity head of bleed flow to, in use, inject said bleed flow into said inlet flow to said pump at a higher total velocity head than the total velocity head of bleed flow at said means adapted to bleed.

27. The pumping system as claimed in claim 26, wherein said means to deliver is a conduit.

28. The pumping system as claimed in claim 27, wherein said means capable of increasing velocity head is provided by a reduction of total cross-sectional flow area of said means to deliver to thereby increase the velocity pressure head of said bleed fluid flow prior to being injected into said inlet conduit.

29. The pumping system as claimed in claim 26, wherein said means to inject is a nozzle.

30. The pumping system as claimed in claim 29, wherein said means capable of increasing velocity head is provided at said nozzle in the form of a reduced total cross-sectional flow area for bleed flow through said nozzle.

31. The pumping system as claimed in claim 29, wherein said nozzle comprises a passage for fluid with an inlet for bleed flow to be received from said means adapted to bleed via said conduit and an outlet connected for bleed flow delivery to said inlet conduit, wherein said inlet of said nozzle is of greater cross sectional area than said outlet of said nozzle.

32. The pumping system as claimed in claim 31, wherein said passage of said nozzle is gradually tapered over a length of said passage between said nozzle inlet and said nozzle outlet such that the cross sectional flow area of said outlet is smaller than the cross-sectional flow area of said inlet of said nozzle.

33. The pumping system as claimed in claim 32, wherein the ratio of said cross sectional flow area of said nozzle inlet to the cross sectional area to said nozzle outlet is substantially four.

34. The pumping system as claimed in claim 32, wherein said passage of said nozzle is substantially circular in cross sectional area and the ratio of inlet diameter to outlet diameter is substantially two.

35. The pumping system as claimed in claim 34, wherein the ratio of the length of said passage to the diameter of said nozzle inlet is substantially two.

36. The pumping system as claimed in claim 29, wherein said nozzle is engaged with said inlet conduit to, in use, inject bleed flow fluid into the inlet conduit through said nozzle outlet at substantially right angles to the main flow direction of fluid in said inlet conduit.

37. The pumping system as claimed in claim 29, wherein said nozzle is engaged with said inlet conduit to, in use, inject bleed fluid into the inlet conduit through said nozzle outlet to induce a rotational flow to inlet flow of fluid approaching said pump.

38. The pumping system as claimed in claim 37, wherein said pump is a centrifugal pump and said rotational flow is co-rotatory with the rotational direction of the pump impeller.

39. The pumping system as claimed in claim 29, wherein there are at least two nozzles for injecting fluid into said inlet conduit.

40. The pumping system as claimed in claim 39, wherein there are four nozzles for injecting fluid into said inlet conduit.

41. The pumping system as claimed in claim 29, wherein said nozzles are each positioned a same distance upstream of said pump.

42. The pumping system as claimed in claim 29, wherein said nozzles are equi-spaced about a perimeter of said inlet conduit.

43. The pumping system as claimed in claim 26, wherein said pump is a centrifugal pump.

44. A pumping system comprising:

means defining a pump having an inlet and an outlet, an in let conduit connected to said inlet of said pump for the inlet flow of fluid to said pump, a delivery conduit connected to said outlet of said pump for the outlet flow of fluid from said pump, means adapted to bleed at least part of the outlet flow as a bleed flow, means capable of increasing a total velocity head of bleed flow, and means to inject a flow responsive to a condition of bleed flow into the inlet conduit whereby in operation the injected flow increases at least the velocity head of inlet flow of fluid to said pump, said means to inject being at least one nozzle in fluid connection via said at least one conduit with said means adapted to bleed, said at least one nozzle comprises a passage for fluid with an inlet for bleed flow to be received from said means adapted to bleed via each said conduit and an outlet connected for bleed flow delivery to said inlet conduit, wherein said inlet of each said nozzle is of greater cross sectional area than said outlet of said nozzle, and a ratio of said cross sectional flow area of each said nozzle inlet to the cross sectional area of said nozzle outlet is substantially four.

45. A pumping system comprising:

means defining a pump having an inlet and an outlet, an inlet conduit connected to said inlet of said pump for the inlet flow of fluid to said pump, a delivery conduit connected to said outlet of said pump for the outlet flow of fluid from said pump, means adapted to bleed at least part of the outlet flow as a bleed flow, means capable of increasing a total velocity head of bleed flow, and means to inject a flow responsive to a condition of bleed flow into the inlet conduit whereby in operation the injected flow increases at least the velocity head of inlet flow of fluid to said pump, said means to inject being at least one nozzle in fluid connection via said at least one conduit with said means adapted to bleed, said at least one nozzle being engaged with said inlet conduit to, in use, inject bleed flow into the inlet conduit through said nozzle outlet at substantially right angles to the main flow direction of fluid in said inlet conduit.

46. A method of pumping a liquid using a pump of a kind having an inlet conduit for input flow of fluid to the in flow chamber of said pump and an outlet conduit for output flow of fluid from the volute chamber of said pump, said method comprising:

bleeding of fluid from the outlet conduit, of a higher total pressure compared to the input flow total pressure, increasing the velocity energy of the bled fluid, and injecting of the bled fluid into the inlet conduit to increase the velocity energy of said input flow, said injecting of bled fluid into said inlet conduit imparting a rotatory flow in the input flow to the pump which is co-rotatory to rotation of a pump impeller.

47. A nozzle unit for injecting fluid into the main inlet flow stream of a pump comprising:

a conduit section capable of insertion into the main inlet conduit defining the flow boundary to said inlet flow stream of said pump, said conduit section comprising an inlet, an outlet, a wall defining region between said inlet and outlet to, in use, provide a substantial continuation of the boundary to the main inlet flow stream of fluid, and at least one aperture through said wall defining region, an injection nozzle for said at least one aperture to in use deliver through said aperture a fluid, said injection nozzle being a conduit having an inlet and an outlet, said outlet being at said at least one aperture through said wall defining region such that a fluid communication can be established between the inlet to said conduit of said nozzle and said main inlet flow stream wherein the flow area of said inlet to said conduit is larger than said outlet to said conduit, said nozzle being secured to said conduit section such that in use the flow path of injected fluid at said outlet to said conduit is at substantially right angles to the main inlet flow stream of said pump.

48. A nozzle unit for injecting fluid into the main inlet flow stream of a pump comprising:

a conduit section capable of insertion into the main inlet conduit defining the flow boundary to said inlet flow stream of said pump, said conduit section comprising an inlet, an outlet, a wall defining region between said inlet and outlet to, in use, provide a substantial continuation of the boundary to the main inlet flow stream of fluid, and at least one aperture through said wall defining region, an injection nozzle for said at least one aperture to in use deliver through said aperture a fluid, said injection nozzle being a conduit having an inlet and an outlet, said outlet being at said at least one aperture through said wall defining region such that a fluid communication can be established between the inlet to said conduit of said nozzle and said main inlet flow stream wherein the flow area of said inlet to said conduit is larger than said outlet to said conduit, said wall defining region of said conduit section being defined by a substantially constant diameter bore corresponding to a diameter of said main inlet conduit.

49. A nozzle unit for injecting fluid into the main inlet flow stream of a pump comprising:

a conduit section capable of insertion into the main inlet conduit defining the flow boundary to said inlet flow stream of said pump, said conduit section comprising an inlet, an outlet, a wall defining region between said inlet and outlet to, in use, provide a substantial continuation of the boundary to the main inlet flow stream of fluid, and at least one aperture through said wall defining region, an injection nozzle for said at least one aperture to in use deliver through said aperture a fluid, said injection nozzle being a conduit having an inlet and an outlet, said outlet being at said at least one aperture through said wall defining region such that a fluid communication can be established between the inlet to said conduit of said nozzle and said main inlet flow stream wherein the flow area of said inlet to said conduit is larger than said outlet to said conduit, said inlet of the conduit of said nozzle being of a flow area substantially four times that of a flow area of the outlet to said conduit.

50. A nozzle unit for injecting fluid into the main inlet flow stream of a pump comprising:

a conduit section capable of insertion into the main inlet conduit defining the flow boundary to said inlet flow stream of said pump, said conduit section comprising an inlet, an outlet, a wall defining region between said inlet and outlet to, in use, provide a substantial continuation of the boundary to the main inlet flow stream of fluid, and at least one aperture through said wall defining region, an injection nozzle for said at least one aperture to in use deliver through said aperture a fluid, said injection nozzle being a conduit having an inlet and an outlet, said outlet being at said at least one aperture through said wall defining region such that a fluid communication can be established between the inlet to said conduit of said nozzle and said main inlet flow stream wherein the flow area of said inlet to said conduit is larger than said outlet to said conduit, said conduit of said nozzle being in cross section substantially circular, and said conduit being gradually tapered between said inlet and said outlet over a distance substantially twice that of the diameter of said inlet to said conduit.

* * * * *